US010324386B2

(12) United States Patent
Fujita et al.

(10) Patent No.: US 10,324,386 B2
(45) **Date of Patent: *Jun. 18, 2019**

(54) ELECTROPHOTOGRAPHIC PHOTORECEPTOR, IMAGE FORMING APPARATUS, IMAGE FORMING METHOD, PRODUCTION METHOD OF ELECTROPHOTOGRAPHIC PHOTORECEPTOR

(71) Applicant: Konica Minolta, Inc., Tokyo (JP)

(72) Inventors: Toshiyuki Fujita, Hachioji (JP); Haruo Horiguchi, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/885,045

(22) Filed: Jan. 31, 2018

(65) Prior Publication Data

US 2018/0224761 A1 Aug. 9, 2018

(30) Foreign Application Priority Data

Feb. 3, 2017 (JP) ..... 2017-018067

(51) Int. Cl.

| | |
|---|---|
| ***G03G 5/00*** | (2006.01) |
| ***G03G 5/06*** | (2006.01) |
| ***G03G 5/147*** | (2006.01) |
| ***G03G 5/047*** | (2006.01) |
| ***G03G 5/10*** | (2006.01) |
| ***G03G 5/07*** | (2006.01) |

(52) U.S. Cl.

CPC ..... *G03G 5/0618* (2013.01); *G03G 5/047* (2013.01); *G03G 5/0614* (2013.01); *G03G 5/071* (2013.01); *G03G 5/102* (2013.01); *G03G 5/1473* (2013.01); *G03G 5/14721* (2013.01); *G03G 5/14734* (2013.01); *G03G 5/14769* (2013.01)

(58) Field of Classification Search

CPC ..... G03G 5/0618; G03G 5/14721; G03G 5/14734; G03G 5/14769

USPC ..... 430/66

See application file for complete search history.

(56) References Cited

U.S. PATENT DOCUMENTS

2015/0261107 A1 9/2015 Kodama et al.

FOREIGN PATENT DOCUMENTS

JP 2009-080403 A 4/2009
JP 2013061625 A 4/2013

OTHER PUBLICATIONS

Office Action dated Jun. 27, 2018 for U.S. Appl. No. 15/837,737.

*Primary Examiner* — Mark A Chapman
(74) *Attorney, Agent, or Firm* — Lucas & Mercanti, LLP

(57) ABSTRACT

An object of the present invention is achieved by an electrophotographic photoreceptor containing a conductive support sequentially laminated thereon with at least a photosensitive layer and a protective layer in that order, wherein the protective layer includes a cured composition having a radical polymerizable compound for a binder, a charge transport agent having a radical polymerizable functional group, and a photopolymerization initiator; the charge transport agent having a radical polymerizable functional group has a maximum absorption wavelength in the range of 405±50 nm; and the charge transport agent having a radical polymerizable functional group and the photopolymerization initiator satisfy Formula (A), Formula (A): $\Delta G = Eox(D/D^{+}) - Ered(A^{-}/A) - E^{*} \leq -0.2$ (eV).

7 Claims, 2 Drawing Sheets

ELECTROPHOTOGRAPHIC PHOTORECEPTOR, IMAGE FORMING APPARATUS, IMAGE FORMING METHOD, PRODUCTION METHOD OF ELECTROPHOTOGRAPHIC PHOTORECEPTOR

The entire disclosure of Japanese Patent Application No. 2017-018067 filed on Feb. 3, 2017 with Japan Patent Office is incorporated herein by reference in its entirety.

TECHNOLOGICAL FIELD

The present invention relates to an electrophotographic photoreceptor, an image-forming apparatus, an image-forming method, and a production method of an electrophotographic photoreceptor. In particular, the present invention relates to an electrophotographic photoreceptor excellent in memory resistive property and abrasion resistive property, and capable of restraining variation of surface roughness, and generation of image fault. The present invention also relates to an image-forming apparatus equipped with the electrophotographic photoreceptor, an image-forming method using the electrophotographic photoreceptor, and a production method of the electrophotographic photoreceptor.

BACKGROUND

In the past, there has been provided an image-forming apparatus with an electrophotographic method for forming an image. In this apparatus, a surface of an electrophotographic photoreceptor is charged, then exposing the charged photoreceptor to form an electrostatic latent image on the photoreceptor. Then, the formed electrostatic latent image is developed with a developer, followed by transferring this to a paper to form an image.

Generally, an electrophotographic photoreceptor (hereafter, it may be called as "a photoreceptor") includes a conductive support laminated thereon: an intermediate layer, a charge generating layer, a charge transport layer, and a protective layer. In recent years, the photoreceptor thus composed has been required to have longer lifetime and higher image quality. In particular, the photoreceptor has been required to be excellent in memory resistive property and abrasion resistive property for enabling to use for a long period of time. In order to achieve these properties, it was proposed a technology in which a curable binder resin, N-type metal oxide particles, and a charge transport material (CTM) were included in the protective layer, for example (refer to Patent document 1: JP-A 2013-61625).

However, according to the above-described technology, the charge transport property of the charge transport agent included in the protective layer is insufficient and a sufficient memory resistive property cannot be obtained. In order to ensure a sufficient memory resistive property, it is desirable to incorporate a charge transport agent having a high charge transport property in the protective layer.

Here, the charge transport agent usually has a photo absorption wavelength in the region of less than 400 nm. The charge transport agent having a high charge transport property will have an extensive π conjugated system. Due to extension of the π conjugated system, the absorption wavelength will be shifted to a longer side. Therefore, when a charge transport agent having a high charge transport property is incorporated in the protective layer, the UV rays to cure the curable binder resin will be absorbed by the charge transport agent. Consequently, a polymerization ratio of the resin composing the protective layer will be lowered to result in decreasing hardness. As a result, an abrasion resistive property (α value) will be lowered, and variation of surface roughness of the photoreceptor will be induced by high coverage printing. In addition, a charge transport agent having a high charge transport property has a large molecular size, and it exhibits low compatibility with a curable binder resin. Therefore, a local charge failure will be produced by aggregation or crystallization of the charge transport agent. It will produce a problem of generating an image fault (a spot fault) by this local charge failure.

SUMMARY

The present invention was done based on the above-described problems and situations. An object of the present invention is to provide an electrophotographic photoreceptor excellent in memory resistive property and abrasion resistive property, and capable of restraining variation of surface roughness, and generation of image fault. An object of the present invention is also to provide an image-forming apparatus equipped with the electrophotographic photoreceptor, an image-forming method using the electrophotographic photoreceptor, and a production method of the electrophotographic photoreceptor.

The reasons of the above-described problems have been investigated in order to solve the above-described problems relating to the present invention. As a result, it was found out to provide the following electrophotographic photoreceptor. The protective layer of the photoreceptor contains: a radical polymerizable compound for a binder; a charge transport agent having a radical polymerizable functional group exhibiting an absorption wavelength in a specific wavelength range; and a photopolymerization initiator. Further, the charge transport agent having a radical polymerizable functional group and the photopolymerization initiator satisfy the specific relationship. By using this photoreceptor, it is possible to provide an electrophotographic photoreceptor excellent in memory resistive property and abrasion resistive property, and capable of restraining variation of surface roughness, and generation of image fault.

Namely, an object relating to the present invention is solved by the following embodiments.

1. An electrophotographic photoreceptor comprising a conductive support sequentially laminated thereon with at least a photosensitive layer and a protective layer in that order, wherein the protective layer includes a cured composition having a radical polymerizable compound for a binder, a charge transport agent having a radical polymerizable functional group, and a photopolymerization initiator;

the charge transport agent having a radical polymerizable functional group has a maximum absorption wavelength in the range of 405±50 nm; and the charge transport agent having a radical polymerizable functional group and the photopolymerization initiator satisfy Formula (A), $$\Delta G = E\mathrm{ox}(D/D^{+}) - E\mathrm{red}(A^{-}/A) - E^{*} \leq -0.2\ (\mathrm{eV}) \qquad \text{Formula (A):}$$

wherein ΔG represents a free energy difference, Eox($D/D^{+}$) represents an oxidation potential of the charge transport agent having a radical polymerizable functional group, Ered ($A^{-}/A$) represents a reduction potential of the photopolymerization initiator, and E* represents an excitation energy of the charge transport agent having a radical polymerizable functional group.

2. The electrophotographic photoreceptor described in the item 1, wherein the photopolymerization initiator has an acyl phosphine oxide structure or an O-acyl oxime structure.

3. The electrophotographic photoreceptor described in the items 1 or 2, wherein the protective layer contains inorganic particles.

4. The electrophotographic photoreceptor described in any one of the items 1 to 3, wherein the charge transport agent having a radical polymerizable functional group contains a structure represented by Formula (1).

Formula (1)

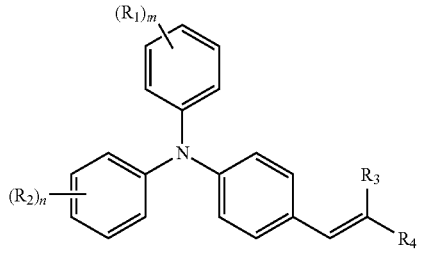

(In Formula (1), $R_1$ and $R_2$ each independently represent a substituent, at least one of $R_1$ and $R_2$ represents a methacryloyloxy group or an acryloyloxy group linked with an alkylene group of 1 to 5 carbon atoms; m and n each independently represent an integer of 0 to 5, provided that both m and n do not represent 0; and $R_3$ and $R_4$ each independently represent a hydrogen atom or a substituted or none-substituted aromatic ring group.)

5. An image-forming apparatus provided with the electrophotographic photoreceptor described in any one of the items 1 to 4.

6. An image-forming method using the electrophotographic photoreceptor described in any one of the items 1 to 4.

7. A method for forming an electrophotographic photoreceptor comprising a conductive support sequentially laminated thereon with at least a photosensitive layer and a protective layer in that order, the method comprising the step of:

curing a composition having a radical polymerizable compound for a binder, a charge transport agent having a radical polymerizable functional group, and a photopolymerization initiator by irradiating with UV rays to form the protective layer, wherein the charge transport agent having a radical polymerizable functional group has a maximum absorption wavelength in the range of 405±50 nm, and the charge transport agent having a radical polymerizable functional group and the photopolymerization initiator satisfy Formula (A), $$\Delta G = Eox(D/D^+) - Ered(A^-/A) - E^* \leq -0.2 \text{ (eV)} \qquad \text{Formula (A):}$$

wherein, ΔG represents a free energy difference, Eox($D/D^+$) represents an oxidation potential of the charge transport agent having a radical polymerizable functional group, Ered ($A^-/A$) represents a reduction potential of the photopolymerization initiator, and E* represents an excitation energy of the charge transport agent having a radical polymerizable functional group.

The present invention enables to provide an electrophotographic photoreceptor excellent in memory resistive property and abrasion resistive property, and capable of restraining variation of surface roughness, and generation of image fault. The present invention also enables to provide an image-forming apparatus equipped with the electrophotographic photoreceptor, an image-forming method using the electrophotographic photoreceptor, and a production method of the electrophotographic photoreceptor.

An expression mechanism or an action mechanism of the effects of the present invention is not clearly identified, but it is supposed as follows.

A charge transport agent excellent in memory resistive property and having a high charge transport property has an extensive π conjugated system. Consequently, it has an absorption wavelength equivalent to a wavelength of UV rays that are irradiated at the time of curing treatment. Therefore, when this charge transport agent is simply added in the protective layer, curing of the protective layer is hindered and hardness of the protective layer is decreased. As a result, even if an excellent memory resistive property is obtained, an abrasion resistive property becomes insufficient, and variation of surface roughness is likely to occur.

In the present invention, by the fact that the charge transport agent having a radical polymerizable functional group and the photopolymerization initiator both satisfy Formula (A), the photopolymerization initiator is sensitized at the time of irradiation with UV rays, and a reaction rate is increased. This enables to promote the curing reaction to result in improving the hardness of the protective layer. As a result, it is possible to provide an electrophotographic photoreceptor excellent in memory resistive property and abrasion resistive property, and capable of restraining variation of surface roughness.

This kind of phenomenon is produced by the following mechanism. The charge transport agent absorbs UV rays that are irradiated for curing treatment of the protective layer. The charge transport agent is excited and the excited charge transport agent affects the photopolymerization initiator. The excited charge transport agent is transited to a lower energy level, while the photopolymerization initiator is changed to an excited state.

This sensitization of the photopolymerization initiator theoretically obeys a Rehm-Weller scheme. When the reduction potential of the photopolymerization initiator becomes lower than the reduction potential of the charge transport agent, namely, when the free energy difference ΔG become negative, it is permitted. However, in reality, there may be added an error caused by a surrounding environment (the contained solvent, or monomer) of the charge transport agent and the photopolymerization initiator. Therefore, the free energy difference ΔG has to be a lower value. By further investigation of the present inventors, it was found out the following: when Formula (A) relating to the present invention is satisfied, the photopolymerization initiator is sufficiently sensitized to attain the level of fully conducting the curing reaction of the protective layer.

Further, since the charge transport agent relating to the present invention has a radical polymerizable group, it is incorporated in the cured layer by making polymerization along with the radical polymerizable compound for a binder. As a result, the charge transport agent increases the cross-linking density and improves abrasion resistive property. It is capable of surely restraining variation of surface roughness.

In addition, the radical polymerizable group included in the charge transport agent has a similar structure to the radical polymerizable compound for a binder. Consequently, the compatibility of the charge transport agent with the radical polymerizable compound for a binder will be improved. Accordingly, the image fault such as spot fault, which is caused by aggregation or crystallization the charge transport agent may be restrained.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
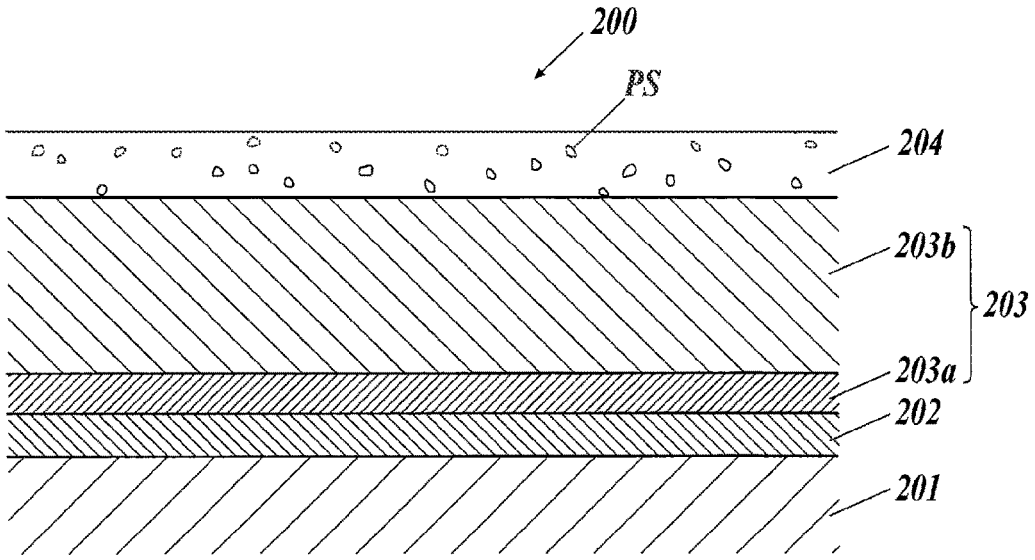
FIG. 1 is a schematic cross-sectional drawing illustrating an example of an electrophotographic photoreceptor of the present invention.

Hereinafter, one or more embodiments of the present invention will be described with reference to the drawings. However, the scope of the invention is not limited to the disclosed embodiments.

An electrophotographic photoreceptor of the present invention contains a conductive support sequentially laminated thereon with at least a photosensitive layer and a protective layer in that order. It is characterized by the following. The protective layer includes a cured composition having a radical polymerizable compound for a binder, a charge transport agent having a radical polymerizable functional group, and a photopolymerization initiator. The charge transport agent having a radical polymerizable functional group has a maximum absorption wavelength in the range of 405±50 nm, and the charge transport agent having a radical polymerizable functional group and the photopolymerization initiator satisfy Formula (A). This is a technical feature commonly owned by the above-described embodiments.

In the present invention, it is preferable that the photopolymerization initiator has an acyl phosphine oxide structure or an O-acyl oxime structure. By this, the reduction potential of the photopolymerization initiator is lowered, and the photopolymerization initiator is likely to be sensitized. Consequently, a high reaction rate is achieved in the curing reaction of the protective layer. As a result, an abrasion resistive property is further improved, and a variation of surface hardness is certainly restrained. Further, an adverse effect caused by addition of the photopolymerization initiator in the protective layer may be certainly restrained.

In the present invention, it is preferable that the protective layer contains inorganic particles. By this, the strength of the protective layer is increased, and the abrasion resistive property is further improved. And at the same time, the variation of surface hardness is certainly restrained.

In the present invention, it is preferable that the charge transport agent having a radical polymerizable functional group contains a structure represented by Formula (1). By this, a memory resistive property is further improved, generation of image fault is certainly restrained, and electrical stability after long term usage is improved. Consequently, it can achieve good balance for each property.

An image-forming apparatus of the present invention is characterized by being provided with the above-described electrophotographic photoreceptor. By this, maintenance frequency of the image-forming apparatus may be decreased, and a sufficiently high quality image is formed under a severe image-forming condition.

An image-forming method of the present invention is characterized by using the above-described electrophotographic photoreceptor. By this, a sufficiently high quality image is formed under a severe image-forming condition.

A method for forming an electrophotographic photoreceptor of the present invention is a method of forming an electrophotographic photoreceptor comprising a conductive support sequentially laminated thereon with at least a photosensitive layer and a protective layer in that order.

The method is characterized by comprising the step of:

curing a composition having a radical polymerizable compound for a binder, a charge transport agent having a radical polymerizable functional group, and a photopolymerization initiator by irradiating with UV rays to form the protective layer, wherein the charge transport agent having a radical polymerizable functional group has a maximum absorption wavelength in the range of 405±50 nm, and the charge transport agent having a radical polymerizable functional group and the photopolymerization initiator satisfy Formula (A). By this, it may be obtained an electrophotographic photoreceptor excellent in memory resistive property and abrasion resistive property, and capable of restraining variation of surface roughness, and generation of image fault.

The present invention and the constitution elements thereof, as well as configurations and embodiments, will be detailed in the following. In the present description, when two figures are used to indicate a range of value before and after "to", these figures themselves are included in the range as a lowest limit value and an upper limit value.

<<Electrophotographic Photoreceptor>>

An electrophotographic photoreceptor of the present invention contains a conductive support sequentially laminated thereon with at least a photosensitive layer and a protective layer in that order. The protective layer includes a cured composition having a radical polymerizable compound for a binder, a charge transport agent having a radical polymerizable functional group, and a photopolymerization initiator. It is characterized in that the charge transport agent having a radical polymerizable functional group has a maximum absorption wavelength in the range of 405±50 nm, and the charge transport agent having a radical polymerizable functional group and the photopolymerization initiator satisfy Formula (A).

$$\Delta G = Eox(D/D^{+}) - Ered(A^{-}/A) - E^{*} \leq -0.2 \text{ (eV)} \qquad \text{Formula (A):}$$

(In Formula (A), ΔG represents a free energy difference, $Eox(D/D^{+})$ represents an oxidation potential of the charge transport agent having a radical polymerizable functional group, $Ered(A^{-}/A)$ represents a reduction potential of the photopolymerization initiator, and E* represents an excitation energy of the charge transport agent having a radical polymerizable functional group.)

The protective layer may contain: a plurality of charge transport agents having a radical polymerizable functional group and having a maximum absorption wavelength in the range of 405±50 nm; and a plurality of photopolymerization initiators. When a plurality of charge transport agents relating to the present invention are contained, it is preferable that at least one photopolymerization initiator is contained with respect to each charge transport agent having a relationship satisfying the above-described Formula (A).

As described above, it is sufficient that the protective layer contains at least a pair of a charge transport agent having a radical polymerizable functional group and having a maximum absorption wavelength in the range of 405±50 nm and a photopolymerization initiator, both satisfying the above-described Formula (A). The protective layer may further contain other charge transport agent and photopolymerization initiator. As other charge transport agent, it may have a radical polymerizable functional group, or it may not have a maximum absorption wavelength in the range of 405±50 nm. The other charge transport agent and the photopolymerization initiator in the protective layer may not satisfy Formula (A). In the same way, as other photopolymerization initiator, it may not satisfy Formula (A) with any charge transport agent in the protective layer.

The photosensitive layer is provided with both functions of generating a charge by absorbing light and transporting the charge. As a layer configuration of the photosensitive layer, it may be a single layer configuration containing a charge generating material and a charge transport material, or it may be a laminated configuration including a charge generating layer incorporating a charge generating material and a charge transport layer incorporating a charge transport material. If required, an intermediate layer may be placed between the conductive support and the photosensitive layer. The layer configuration of the photosensitive layer is not specifically limited. Examples of a specific layer configuration including the protective layer and the intermediate layer are as follows.

(1) A layer configuration having a conductive support sequentially laminated thereon with a photosensitive layer including a charge transport layer and a charge transport layer, and a protective layer.

(2) A layer configuration having a conductive support sequentially laminated thereon with a mono-layer photosensitive layer incorporating a charge generating material and a charge transport material, and a protective layer.

(3) A layer configuration having a conductive support sequentially laminated thereon with an intermediate layer, a photosensitive layer including a charge transport layer and a charge transport layer, and a protective layer.

(4) A layer configuration having a conductive support sequentially laminated thereon with an intermediate layer, a mono-layer photosensitive layer incorporating a charge generating material and a charge transport material, and a protective layer.

An electrophotographic photoreceptor of the present invention may be any one of the layer configurations (1) to (4). Among them, the layer configuration (3) is most preferable.

FIG. 1 is a cross-sectional drawing illustrating an example of a layer configuration of an electrophotographic photoreceptor of the present invention.

As illustrated in FIG. 1, an electrophotographic photoreceptor 200 of the present invention is configured on a conductive support 201 sequentially laminated thereon with an intermediated layer 202, a photosensitive layer 203, and a protective layer 204 in that order.

The photosensitive layer 203 includes a charge generating layer 203*a* and a charge transport layer 203*b*. The protective layer 204 contains metal oxide particles PS as inorganic particles.

An electrophotographic photoreceptor of the present invention is an organic photoreceptor. The organic photoreceptor designates an electrophotographic photoreceptor in which at least one of the functions of the charge generating function and the charge transport function, which are essential to the constitution of the electrophotographic photoreceptor, is exhibited by an organic compound. It contains: a photoreceptor including a known organic charge generating material and organic charge transport material; and a photoreceptor including a polymer complex for a charge generating function and a charge transport function.

(Calculation Method of ΔG in Formula (A))

ΔG in Formula (A) relating to the present invention may be obtained as described below.

Namely, $Eox(D/D^+)$ in the above-described Formula (A) is approximately a reverse sign of the HOMO (Highest occupied molecular orbital) of the charge transport agent relating to the present invention. $Ered(A^-/A)$ in the above-described Formula (A) is approximately a reverse sign of the LUMO (Lowest unoccupied molecular orbital) of the photopolymerization initiator relating to the present invention.

HOMO, LUMO, and E* of the charge transport agent and the photopolymerization initiator are calculated using Gaussian 09 software made by Gaussian, Inc. (The used Gaussian 09 Revision C. 01 was made by: M. J. Frisch, G. W. Trucks, H. B. Schlegel, G. E. Scuseria, M. A. Robb, J. R. Cheeseman, G. Scalmani, V. Barone, B. Mennucci, G. A. Petersson, H. Nakatsuji, M. Caricato, X. Li, H. P. Hratchian, A. F. Izmaylov, J. Bloino, G. Zheng, J. L. Sonnenberg, M. Hada, M. Ehara, K. Toyota, R. Fukuda, J. Hasegawa, M. Ishida, T. Nakajima, Y. Honda, O. Kitao, H. Nakai, T. Vreven, J. A. Montgomery, Jr., J. E. Peralta, F. Ogliaro, M. Bearpark, J. J. Heyd, E. Brothers, K. N. Kudin, V. N. Staroverov, T. Keith, R. Kobayashi, J. Normand, K. Raghavachari, A. Rendell, J. C. Burant, S. S. Iyengar, J. Tomasi, M. Cossi, N. Rega, J. M. Millam, M. Klene, J. E. Knox, J. B. Cross, V. Bakken, C. Adamo, J. Jaramillo, R. Gomperts, R. E. Stratmann, O. Yazyev, A. J. Austin, R. Cammi, C. Pomelli, J. W. Ochterski, R. L. Martin, K. Morokuma, V. G. Zakrzewski, G. A. Voth, P. Salvador, J. J. Dannenberg, S. Dapprich, A. D. Daniels, O. Farkas, B. Foresman, J. V. Ortiz, J. Cioslowski, and D. J. Fox; Gaussian Inc., Wallingford Conn., 2010.) A density functional formalism (B3LYP/6-31G(d)) may be used as a calculation method. A similar value may be obtained without limitation of the software and the calculation method.

From the values obtained, ΔG may be obtained based on Formula (A).

<<Protective Layer>>

A protective layer relating to the present invention includes a cured composition having: a radical polymerizable compound for a binder, a charge transport agent having a radical polymerizable functional group exhibiting a maximum absorption wavelength in the range of 405±50 nm, and a photopolymerization initiator. The protective layer relating to the present invention may contain inorganic particles. The materials that compose the protective layer will be successively described.

(1) Photopolymerization Initiator

As a photopolymerization initiator relating to the present invention, it may be any one that satisfies the above-described Formula (A). From the viewpoint of certainly restraining an adverse effect such as decrease of memory resistive property, it is preferable to use a photopolymerization initiator of one molecule type having an acyl phosphine oxide structure or an O-acyl oxime structure. These may be used alone, or they may be used in combination of plural kinds. In the present invention, "a photopolymerization initiator of one molecule type" designates a material that one molecule thereof functions as an initiator. "A photopolymerization initiator of two molecule type" designates a material that two or more molecules thereof functions as an initiator.

Specific examples of a photopolymerization initiator having an acyl phosphine oxide structure are indicated in the following.

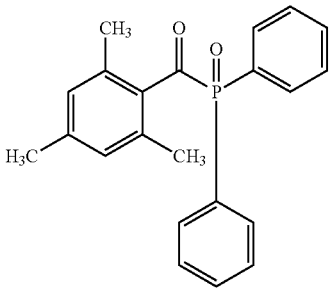

Irgacure TPO

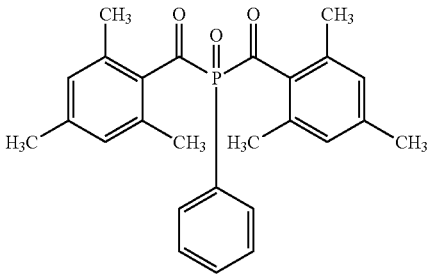

Irgacure 819

Among the above-described Irgacure TPO (made by BASF Japan Co. Ltd.) and Irgacure 819 (made by BASF Japan Co. Ltd.), Irgacure 819 (made by BASF Japan Co. Ltd.) is preferably used.

Examples of a photopolymerization initiator having an O-acyl oxime structure are: Irgacure OXE02 (PI-8) (made by BASF Japan Co. Ltd.) and compound PI-9.

PI-8

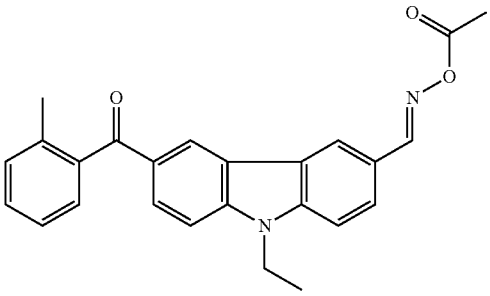

-continued

PI-9

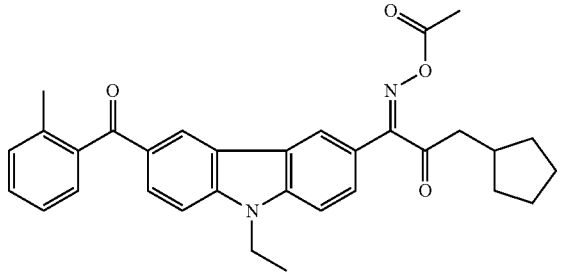

In the present invention, as a photopolymerization initiator having an O-acyl oxime structure, a preferable one is a photopolymerization initiator having a structure represented by Formula (3).

Formula (3)

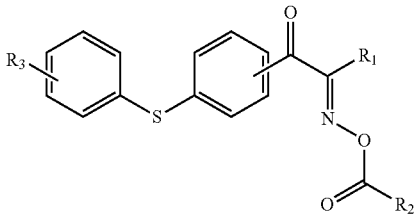

In Formula (3), $R_1$ and $R_2$ each independently represent a hydrogen atom, a substituted or unsubstituted alkyl group of 1 to 6 carbon atoms, a substituted or unsubstituted cycloalkyl group of 3 to 6 carbon atoms, or a substituted or unsubstituted aryl group.

$R_3$ represents a hydrogen atom, a substituted or unsubstituted alkyl group of 1 to 6 carbon atoms, a substituted or unsubstituted alkoxy group of 1 to 6 carbon atoms, a substituted or unsubstituted aryl group, a halogen atom, a cyano group, a nitro group, a hydroxy group, or a substituted or unsubstituted carbonyl group.

Specific examples of an alkyl group, a cycloalkyl group, an aryl group, or alcohol group in Formula (3) are identical with an alkyl group, a cycloalkyl group, or an alkoxy group represented by $R_1$ and $R_2$ in Formula (1) described later, and an aromatic hydrocarbon ring group represented by $R_3$ and $R_4$ in Formula (1) described later. Specific examples of a substituent in Formula (3) are identical with the substituent represented by $R_1$ and $R_2$ in Formula (1) described later.

Specific examples of a compound represented by Formula (3) are indicated below.

B-1

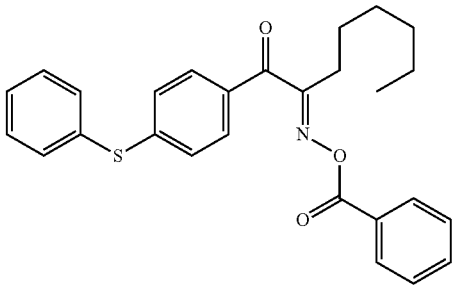

(OXE01)

-continued
B-2
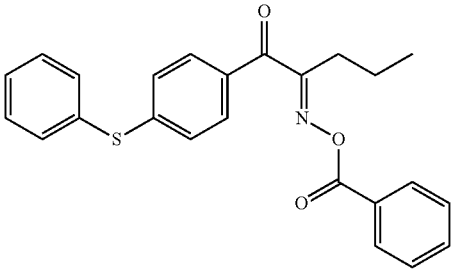
B-3
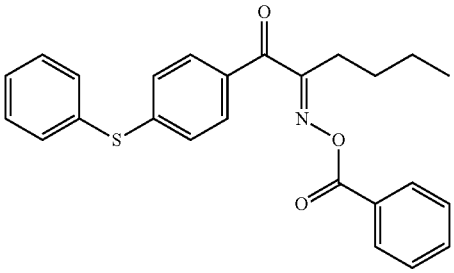
B-4
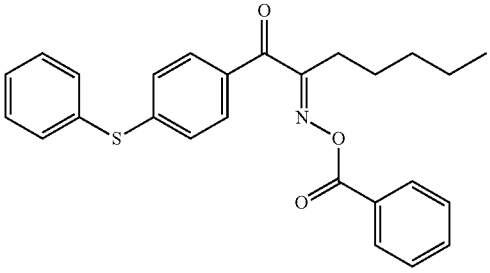
B-5
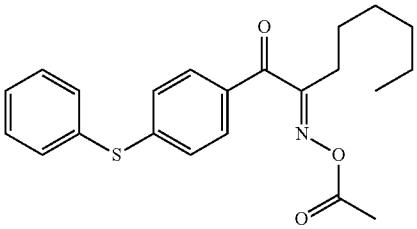
B-6
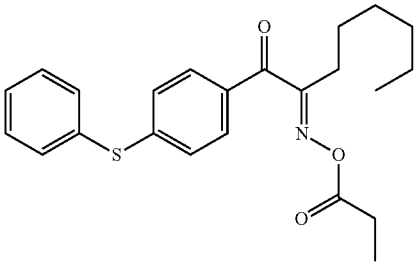
B-7
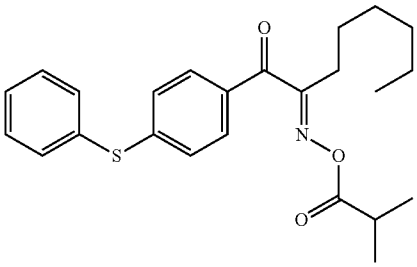
-continued
B-8
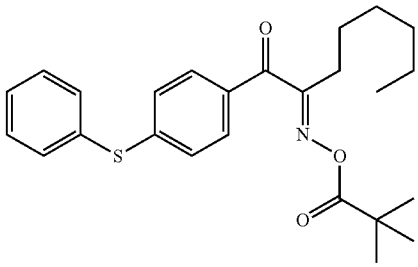
B-9
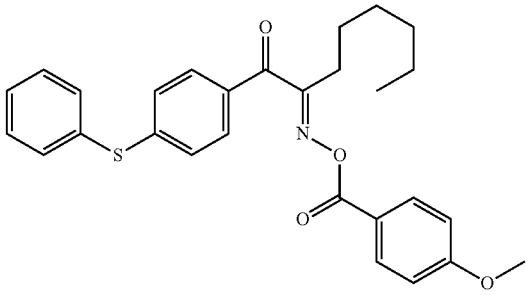
B-10
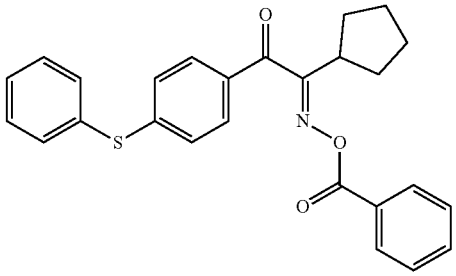
B-11
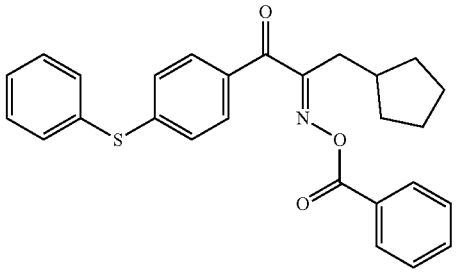
B-12
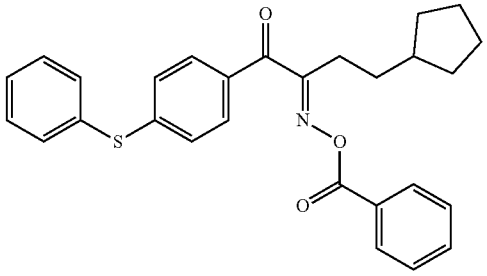

-continued
B-13
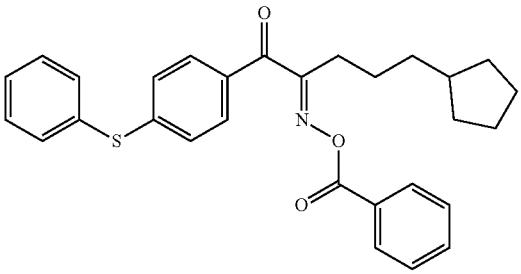
B-14
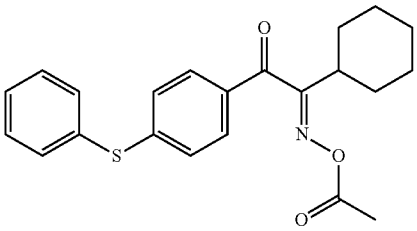
B-15
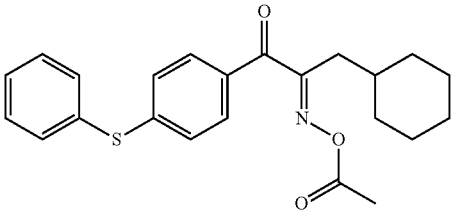
B-16
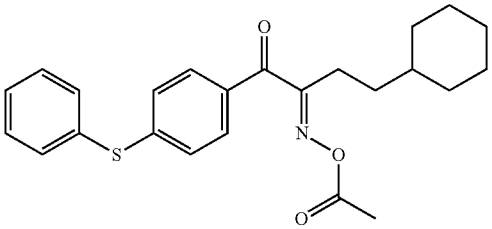
B-17
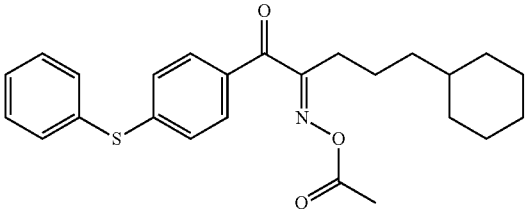
B-18
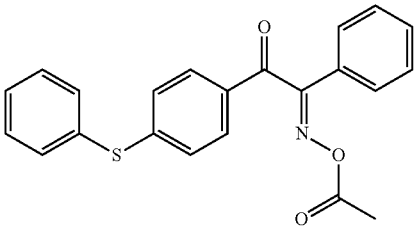
-continued
B-19
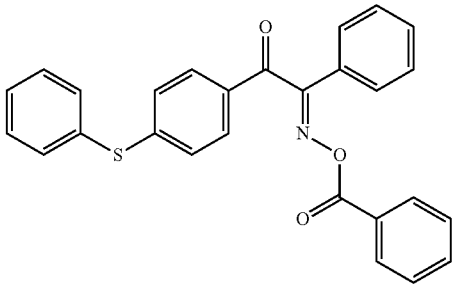
B-20
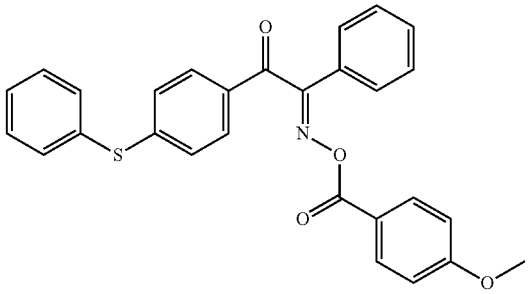
B-21
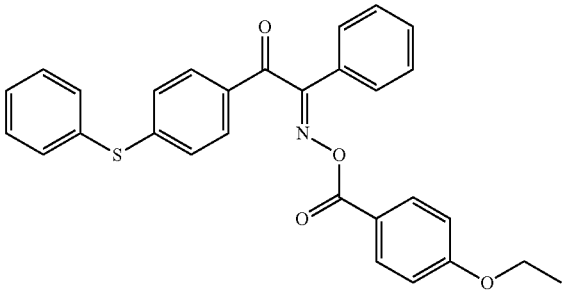
B-22
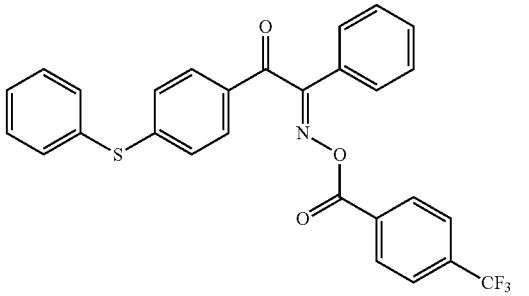
B-23
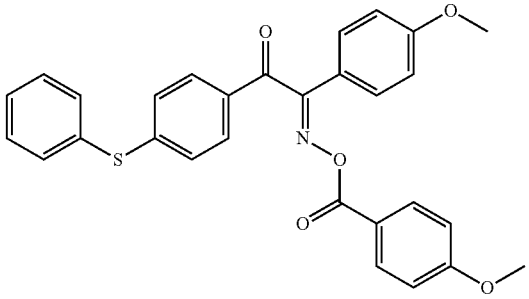

-continued
B-24
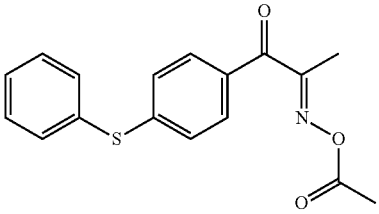
B-25
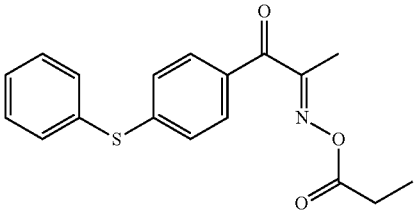
B-26
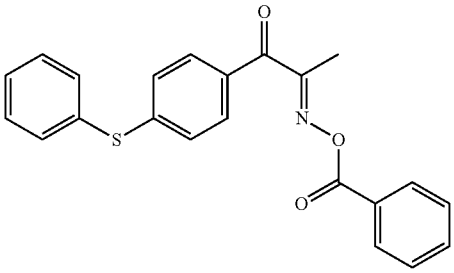
B-27
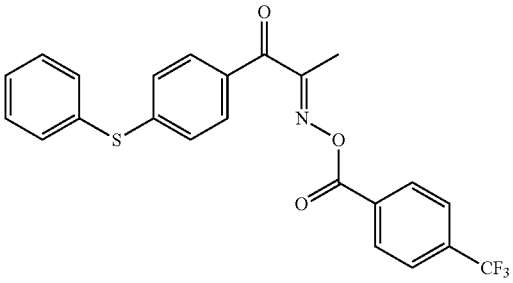
B-28
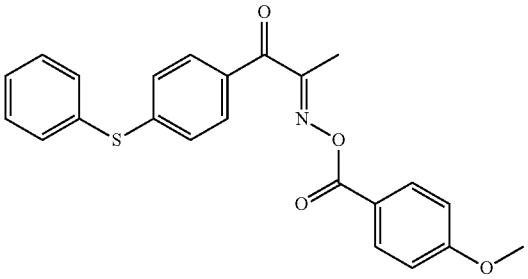
-continued
B-29
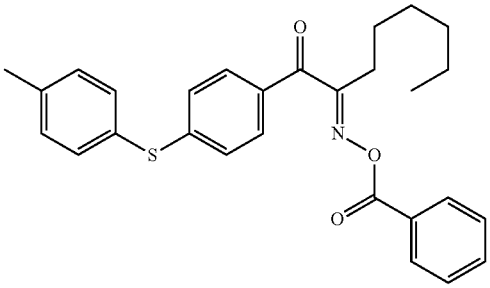
B-30
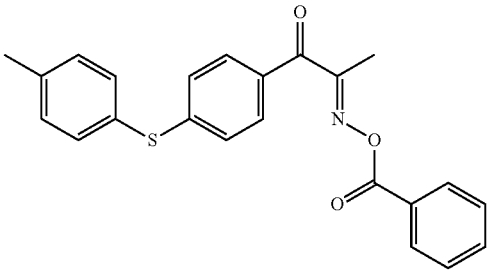
B-31
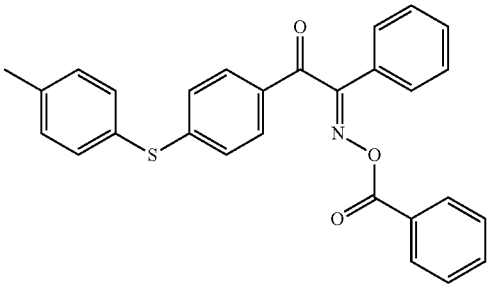
B-32
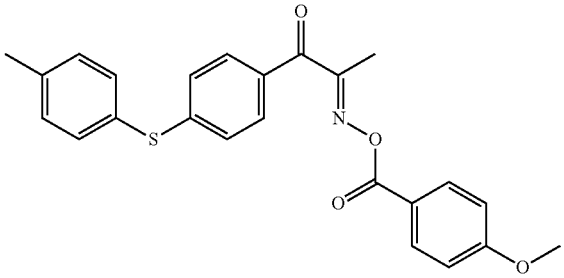
B-33
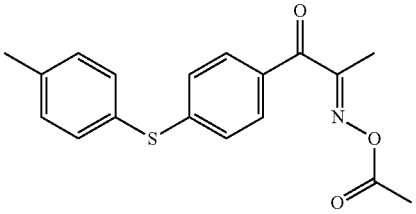

-continued

B-34

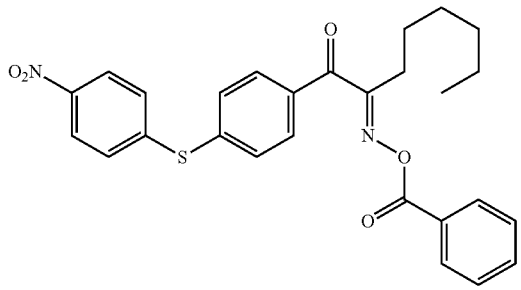

B-35

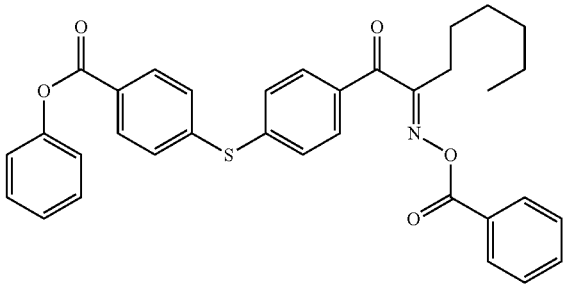

B-36

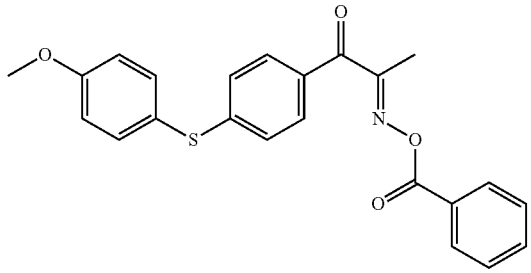

B-37

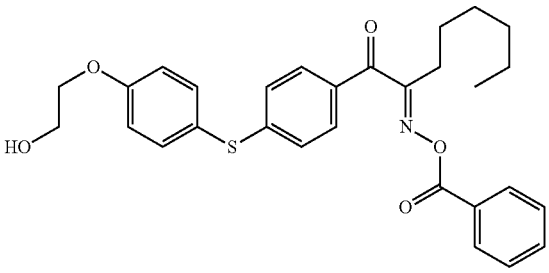

B-38

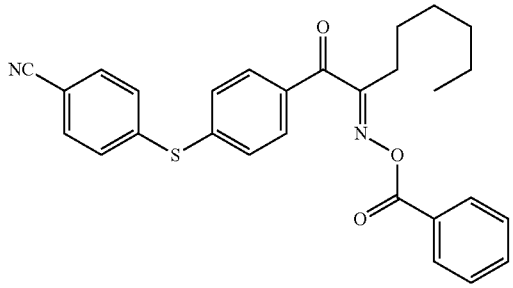

-continued

B-39

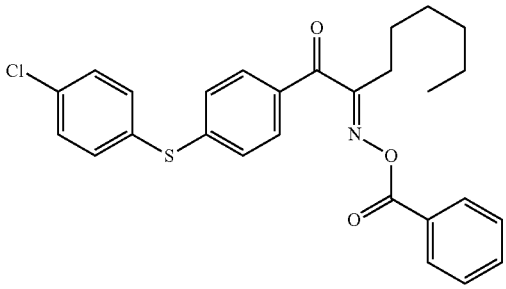

Examples of a photopolymerization initiator having an O-acyl oxime structure are: an exemplified compound B-1 (Irgacure OXE01, made by BASF Japan Co. Ltd.), PBG-305, and PBG-329. These two compounds are a photopolymerization initiator of an O-acyl oxime type containing a disulfide structure, and they are made by Changzhou Tronly New Electronic Materials Co. Ltd.)

A photopolymerization initiator relating to the present invention is not limited to the above-described photopolymerization initiator of one molecule type. A photopolymerization initiator of two molecule type may be also used. In the case of a photopolymerization initiator of two molecule type, among compounds constituting the photopolymerization initiator, it is sufficient that the compound which is initially activated by absorbing light satisfies Formula (A) relating to the present invention. As a photopolymerization initiator of two molecule type, it may be cited a combination of a compound having a hexaaryl bisimidazole structure and a thiol compound.

Specific examples of a compound having a hexaaryl bisimidazole structure used in a photopolymerization initiator of two molecule type are indicated in the following.

PI-1

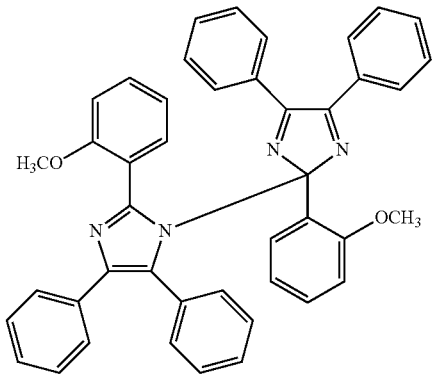

-continued

PI-2

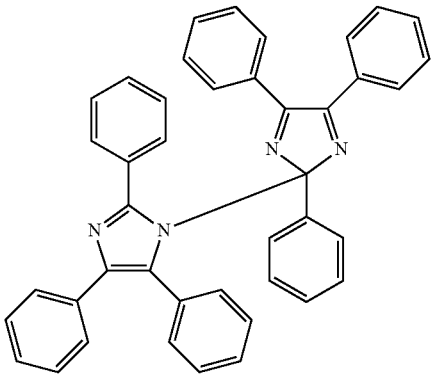

PI-3

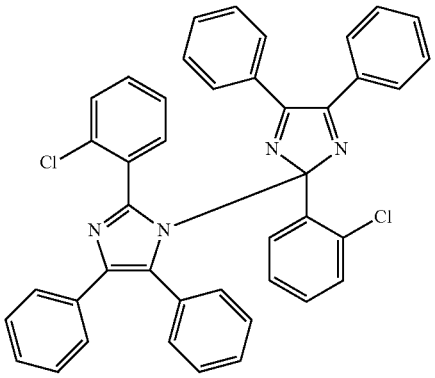

PI-4

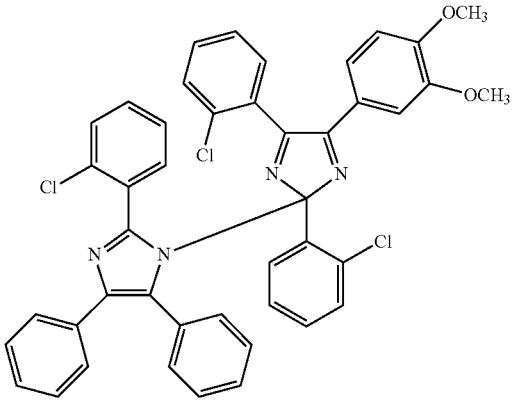

PI-5

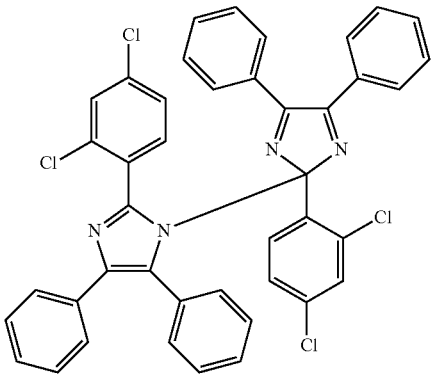

A specific example of a thiol compound used in a photopolymerization initiator of two molecule type is indicated in the following.

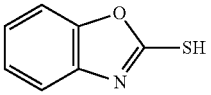

An added ratio of the photopolymerization initiator that satisfies Formula (A) of the present invention is preferably in the range of 0.1 to 20 mass parts to 100 mass parts of the radical polymerizable compound for a binder, and more preferably in the range of 0.5 to 10 mass parts.

As described above, the protective layer may further contain other photopolymerization initiator that does not satisfy Formula (A) (a photopolymerization initiator out of the relation of Formula (A)), in addition to a photopolymerization initiator that satisfies Formula (A).

In that case, a content of the photopolymerization initiator that satisfies Formula (A) is preferably in the range of 20 volume % or more to the total amount of the photopolymerization initiator contained in the protective layer. More preferably, it is in the range of 30 volume % or more.

(2) Radical Polymerizable Compound for Binder

As a radical polymerizable compound for a binder relating to the present invention, it may be used a monomer that constitutes a binder resin for a photoreceptor by polymerizing (curing) with a radical polymerization initiator. Examples of a binder resin are polystyrene, and polyacrylate. Incidentally, the radical polymerizable compound for a binder relating to the present invention does not include a charge transport agent relating to the present invention.

As a radical polymerizable compound for a binder, it is preferable to use a polymerizable compound of cross-linking type from the viewpoint of keeping high durability. A specific example of a polymerizable compound of cross-linking type is a polymerizable compound having two or more radical polymerizable functional groups (hereafter, it is also called as "a polyfunctional radical polymerizable compound").

It may be used a compound having one radical polymerizable functional group (hereafter, it is also called as "a monofunctional radical polymerizable compound") in combination with the above-described polyfunctional radical polymerizable compound. When a monofunctional radical polymerizable compound is used, a content thereof is preferably 20 mass % or less to the total amount of the monomer for forming a binder resin. Examples of a radical polymerizable functional group include: a vinyl group, an acryloyl group, a methacryloyl group, an acryloyloxy group, and methacryloyloxy group.

As a polyfunctional radical polymerizable compound, it is particularly preferable to use an acryl type monomer or an oligomer having two or more acryloyl groups ($CH_2{=}CHCO{-}$), or methacryloyl groups ($CH_2{=}CCH_3CO{-}$). Consequently, the resin is preferably an acryl type resin formed with an acryl type monomer or an acryl type oligomer.

In the present invention, the polyfunctional radical polymerizable compound may be used alone, or it may be used by mixing a plurality of kinds. Further, this polyfunctional radical polymerizable compound may be a monomer or an oligomer.

Specific examples of a polyfunctional radical polymerizable compound are indicated in the following.

M1

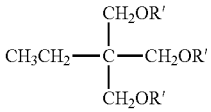

M2

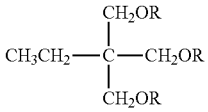

M3

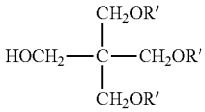

M4

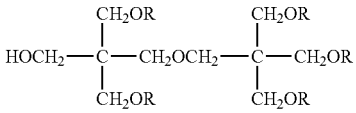

M5

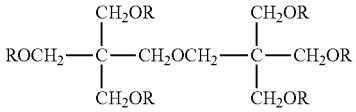

M6

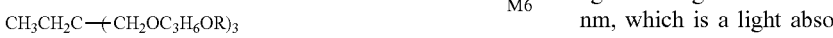

M7

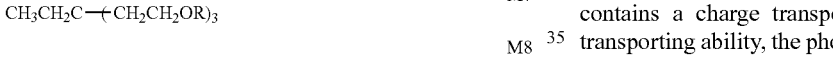

M8

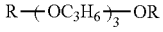

M9

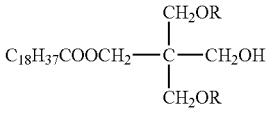

M10

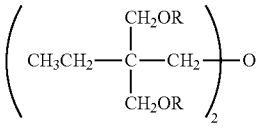

M11

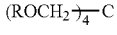

M12

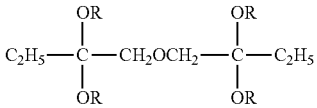

M13

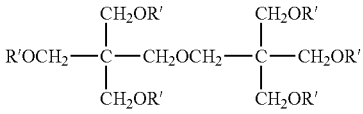

M14

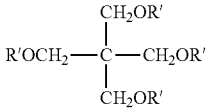

In the chemical formulas indicating the exemplary compounds M1 to M14, R represents an acryloyl group ($CH_2{=}CHCO{-}$), and R' represents a methacryloyl group ($CH_2{=}CCH_3CO{-}$).

(3) Charge Transport Agent

As a charge transport agent relating to the present invention, it may be used any charge transport agent as long as it has a radical polymerizable functional group and has a maximum absorption wavelength in the range of 405±50 nm, and further it satisfies the above-described Formula (A). Here, a charge transport agent designates a compound having a function of transporting a hole.

It is preferable that the charge transport agent relating to the present invention has a molecular weight in the range of 250 to 800. When it has a molecular weight of 250 or more, it enables to prevent decrease of charge transport function. As a result, a memory resistive property is increased. Further, when it has a molecular weight of 800 or less, it is likely to maintain a surface hardness of the protective layer.

Since the charge transport agent relating to the present invention has a maximum absorption wavelength in the range of 405±50 nm, it has a high charge transporting ability. As a result, it enables to give a sufficient memory resistive property.

When the protective layer contains a charge transport agent having a maximum absorption wavelength about 405 nm, which is a light absorption wavelength of a photopolymerization initiator, that is, when the protective layer contains a charge transport agent having a high charge transporting ability, the photopolymerization initiator cannot receive a sufficient amount of energy required for UV curing. Therefore, curing defect (curing hindrance) will be induced. In the present invention, the protective layer may be cured to have an excellent memory resistive property without generating curing defect by using a photopolymerization initiator and a charge transport agent that satisfy Formula (A). Therefore, the abrasion resistive property may be improved, and the variation of the surface roughness may be restrained.

In the present invention, a maximum absorption wavelength of a charge transport agent is a local maximum value of an absorption peak of a tetrahydrofuran solution of a charge transport agent dissolved with a density of $1.0\times10^{-5}$ mol/L. The measurement is carried out at 25° C. using a usual absorption spectrophotometer. The maximum absorption wavelength is not necessary a largest absorption wavelength. It is a local maximum value point. A plurality of local maximum value points may exist.

An added ratio of the charge transport agent relating to the present invention is preferably in the range of 10 to 100 mass parts to 100 mass parts of the radical polymerizable compound for a binder, and more preferably in the range of 20 to 60 mass parts.

(3.1) Compound Having a Structure Represented by Formula (1)

It is preferable that the charge transport agent relating to the present invention is a compound having a structure represented by Formula (1) described in the following.

Formula (1)

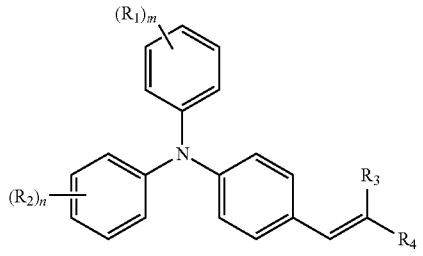

In Formula (1), $R_1$ and $R_2$ each independently represent a substituent, at least one of $R_1$ and $R_2$ represents a methacryloyloxy group or an acryloyloxy each linked with an alkylene group of 1 to 5 carbon atoms; m and n each independently represent an integer of 0 to 5, provided that both of m and n do not represent an integer of 0 at the same time; and $R_3$ and $R_4$ each independently represent a hydrogen atom, or a substituted or unsubstituted aromatic ring group.

In Formula (1), examples of a substituent represented by $R_1$ and $R_2$ include: an alkyl group for example, a methyl group, an ethyl group, a propyl group, an isopropyl group, t-butyl group, a pentyl group, a hexyl group, a octyl group, a dodecyl group, a tridecyl group, a tetradecyl group, a pentadecyl group, and a benzyl group) an alkoxy group (for example, a methoxy group, an ethoxy group, a propyloxy group, a butoxy group, a pentyloxy group, a hexyloxy group, an octyloxy group, and a dodecyloxy group) an acryloyloxy group, a methacryloyloxy group, a cycloalkyl group for example, a cyclopropyl group, a cyclobutyl group, a cyclopentyl group and a cyclohexyl group) an alkenyl group for example, a vinyl group an allyl group), and an alkynyl group (for example, a propargyl group).

Among them, preferable examples are: an alkyl group, an alkoxy group, an acryloyloxy group, and a methacryloyloxy group.

In addition, these substituents may be further substituted with the substituents as described above, and these substituents may be mutually condensed to form a ring. The examples of the substituent are not limited to the specific groups described in the above-described parentheses. In the compounds represented by Formula (1) having m being an integer of 2 to 5, the substituents represented by $R_1$ may be the same or different with each other. In the compounds represented by Formula (1) having n being an integer of 2 to 5, the substituents represented by $R_2$ may be the same or different with each other.

In Formula (1), at least one of $R_1$ and $R_2$ represents a methacryloyl group or an acryloyl each linked with an alkylene group of 1 to 5 carbon atoms. Among them, a preferable group is a methacryloyloxy group or an acryloyloxy group each linked with a methylene group.

In Formula (1), examples of an aromatic ring group represented by $R_3$ or $R_4$ include: an aromatic hydrocarbon ring group (it may be called as an aryl group) such as a phenyl group, a p-chlorophenyl group, a mesityl group, a tolyl group, a xylyl group, a naphthyl group, an anthryl group, an azulenyl group, an acenaphthenyl group, a fluorenyl group, a phenanthryl group, an indenyl group, pyrenyl group, and a biphenylyl group; an aromatic heterocyclic group such as a pyridyl group, a pyrimidinyl group, a furyl group, a pyrrolyl group, an imidazolyl group, a benzimidazolyl group, a pyrazolyl group, a pyrazinyl group, a triazolyl group (for example, 1,2,4-triazol-1-yl group and 1,2,3-triazol-1-yl group), an oxazolyl group, a benzoxazolyl group, a thiazolyl group, an isoxazolyl group, an isothiazolyl group, a furazanyl group, a thienyl group, a quinolyl group, a benzofuryl group, a dibenzofuryl group, a benzothienyl group, a dibenzothienyl group, an indolyl group, a carbazolyl group, a carbolinyl group, a diazacarbazole group (it is a group in which at least one of the carbon atoms constituting the carboline ring of the carbolinyl group is replaced with a nitrogen atom), a quinoxalinyl group, a pyridazinyl group, a triazinyl group, a quinazolinyl group, and a phthalazinyl group.

These groups may be further substituted with the substituents represented by $R_1$ or $R_2$ as described above, and those groups may be mutually condensed to form a ring.

The compound represented by Formula (1) is preferably a compound further represented by Formula (2) as described in the following.

Formula (2)

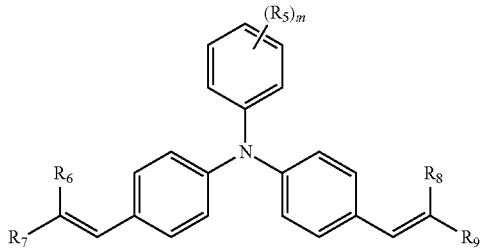

In Formula (2), $R_5$ represents a substituent, at least one of $R_5$s represents a methacryloyloxy group or an acryloyloxy each linked with an alkylene group of 1 to 5 carbon atoms; m represents an integer of 1 to 5; and $R_6$ to $R_9$ each independently represent a hydrogen atom, or a substituted or unsubstituted aromatic ring group.

As a substituent represented by $R_5$ in Formula (2), it may be cited the same substituents as represented by $R_1$ and $R_2$ in Formula (1).

In Formula (2), as a substituted or unsubstituted aromatic ring group represented by $R_6$ to $R_9$, it may be cited the same substituted or unsubstituted aromatic ring group represented by $R_3$ and $R_4$ in Formula (2).

(3.2) Specific Examples

Specific examples of a compound represented by Formula (1) or Formula (2) are indicated in the following. However, the present invention is not limited to them.

RCTM-1

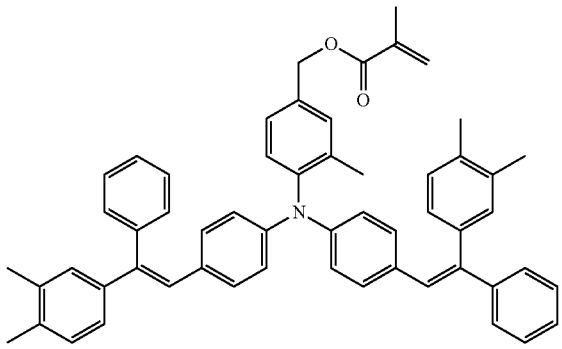

-continued
RCTM-2
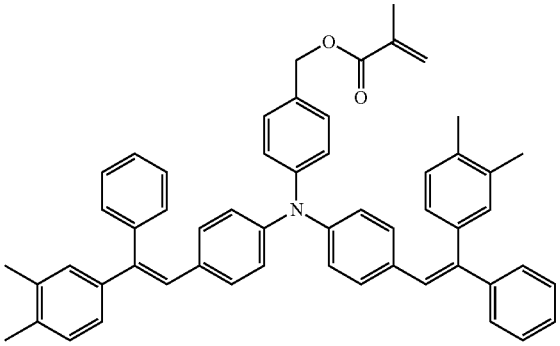
RCTM-3
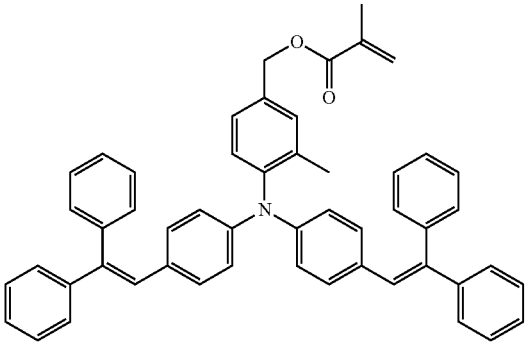
RCTM-4
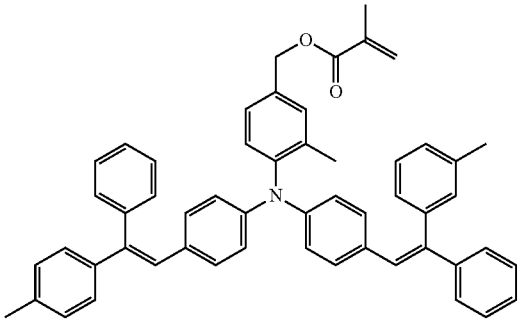
RCTM-5
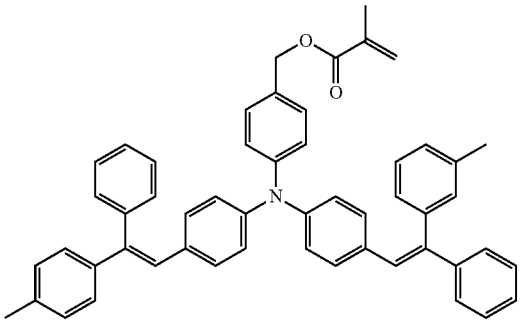
-continued
RCTM-6
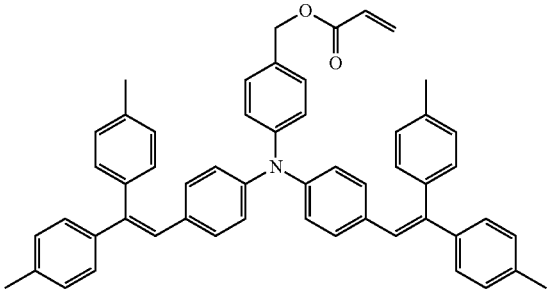
RCTM-7
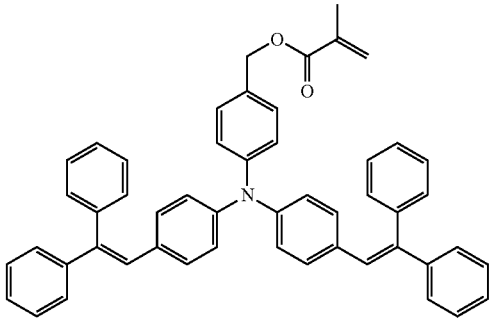
RCTM-8
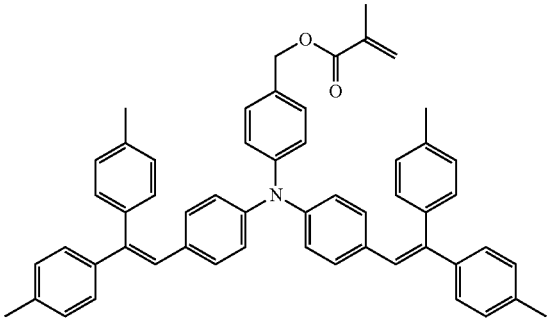
RCTM-9
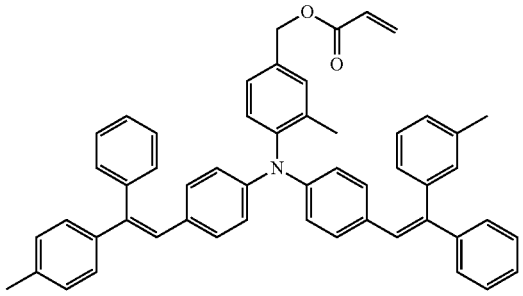
RCTM-10
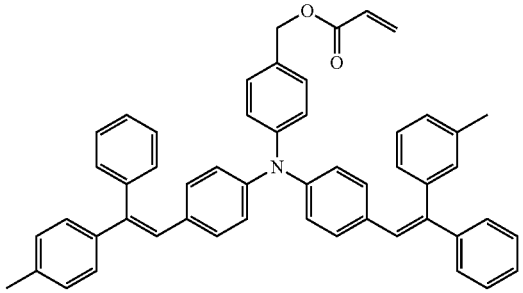

-continued
RCTM-11
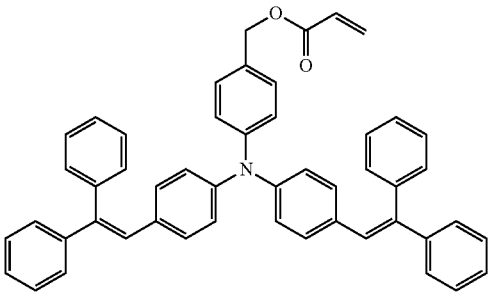
RCTM-12
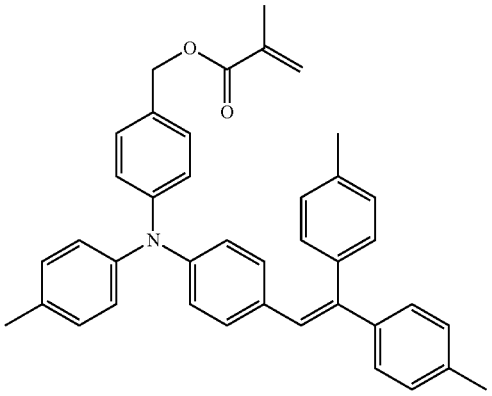
RCTM-13
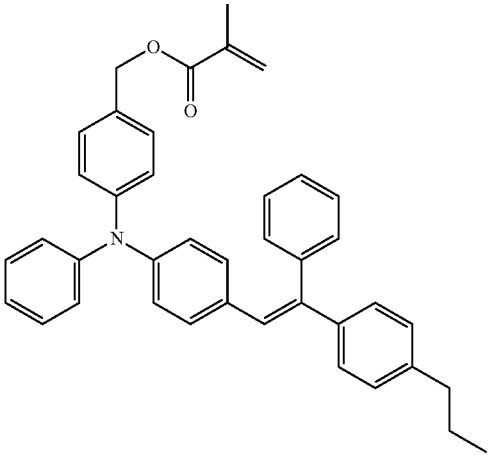
RCTM-14
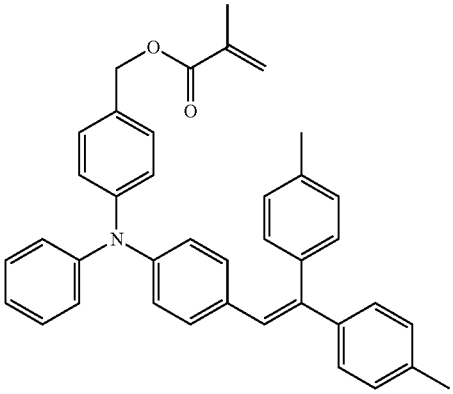
-continued
RCTM-15
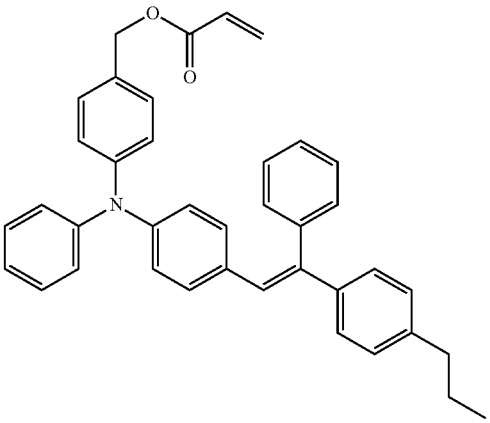
RCTM-16
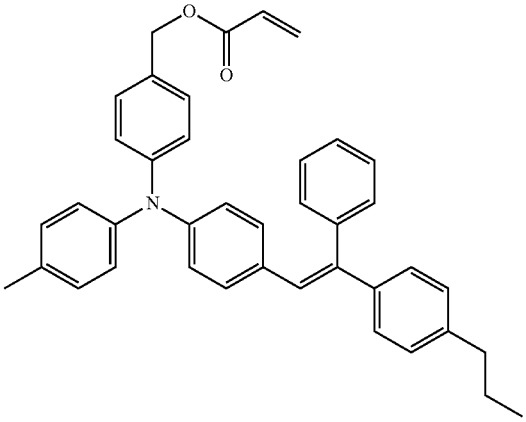
RCTM-17
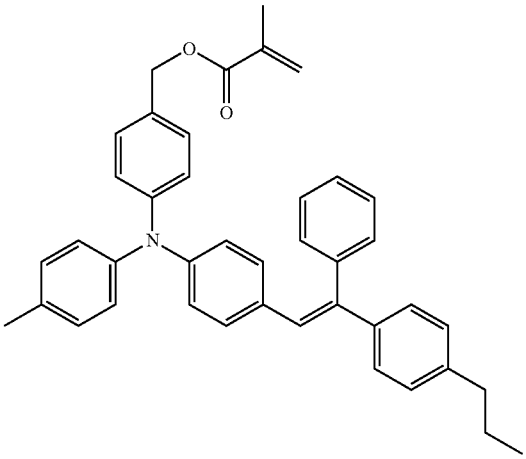

-continued
RCTM-18
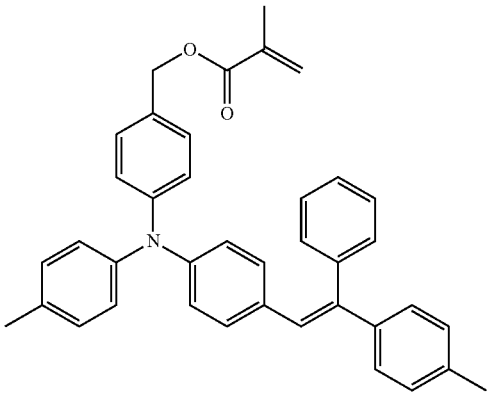
RCTM-19
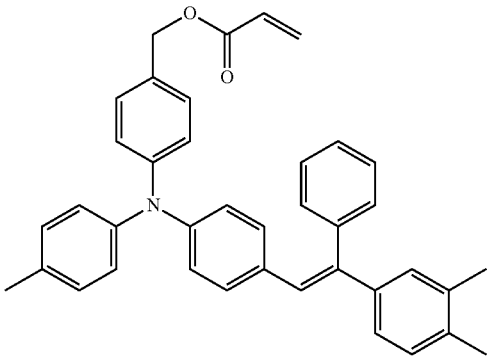
RCTM-20
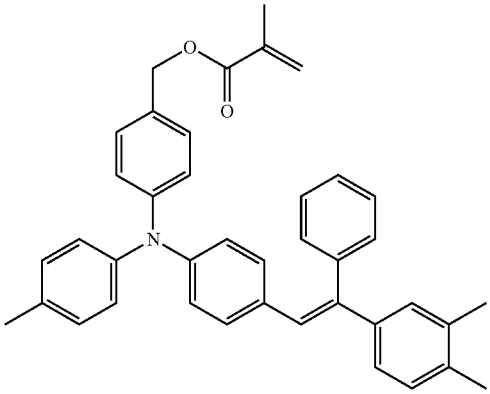
RCTM-21
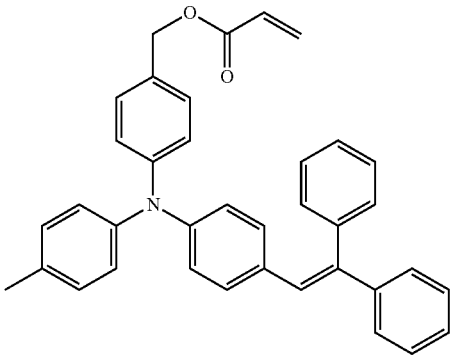
-continued
RCTM-22
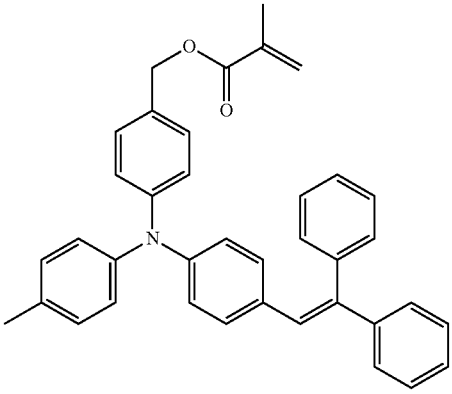
RCTM-23
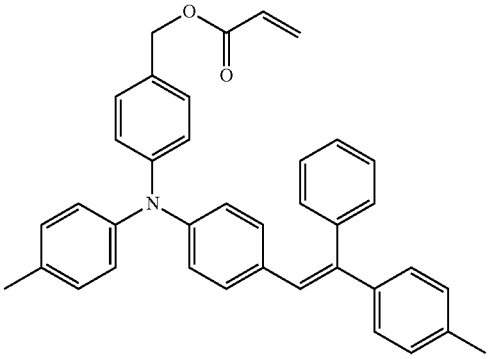
RCTM-24
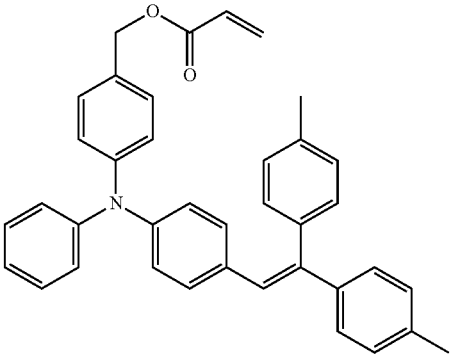
RCTM-27
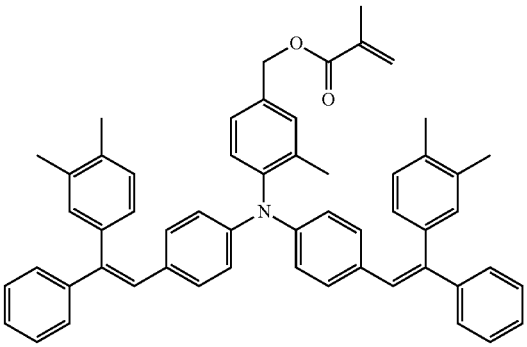

-continued
RCTM-31
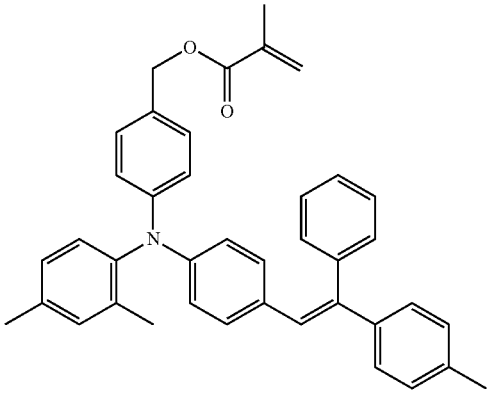
RCTM-32
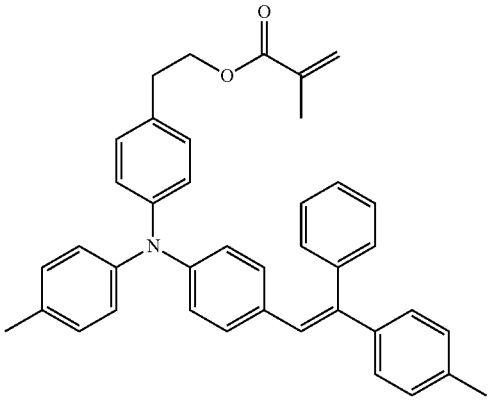
RCTM-33
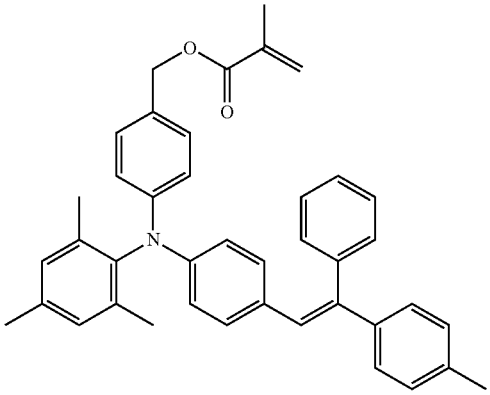
-continued
RCTM-34
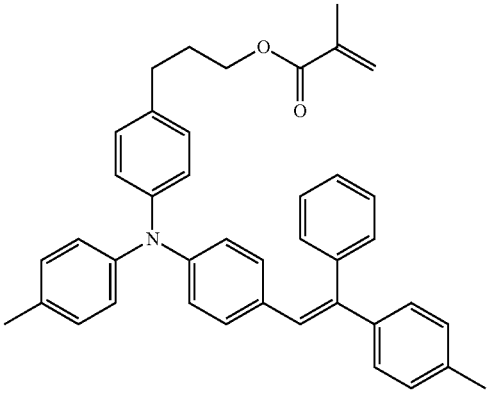
RCTM-35
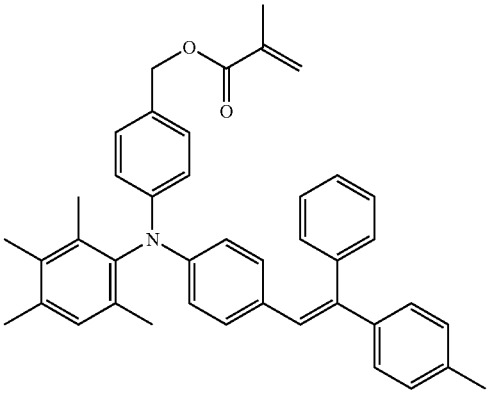
RCTM-36
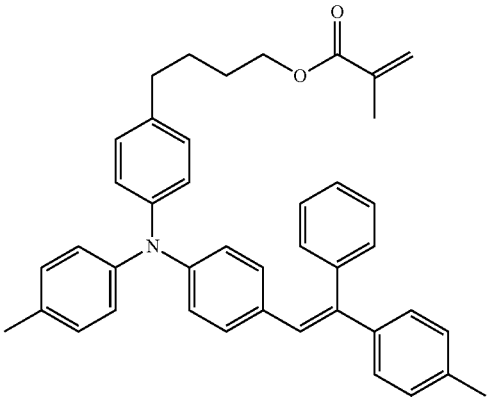

-continued

RCTM-37

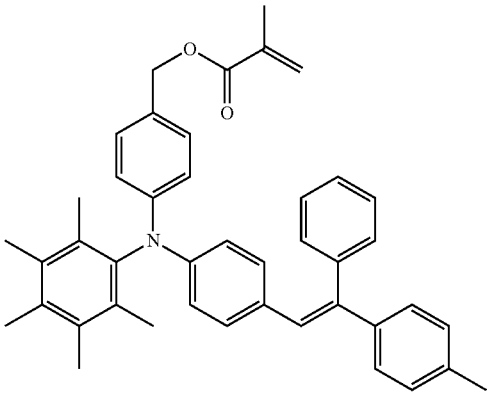

RCTM-38

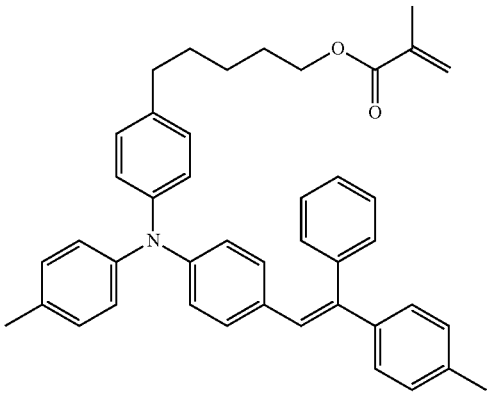

A specific example of a charge transport agent relating to the present invention, which has not a structure represented by Formula (1) or Formula (2), is indicated in the following. However, the present invention is not limited to this.

RCTM-25

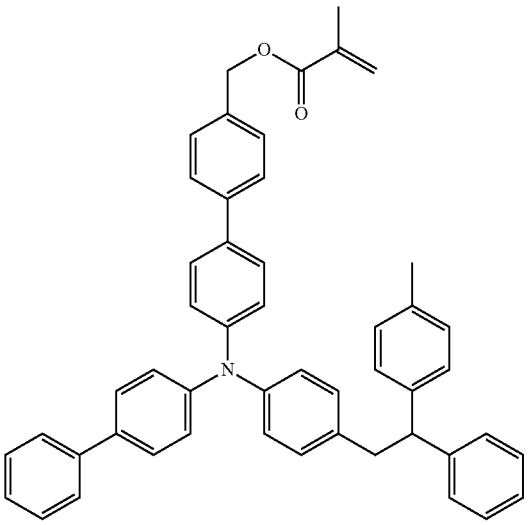

(3.3) Synthetic Example

A synthetic example of a compound having a structure represented by Formula (1) or Formula (2) is described by referring to the above-described RCTM-27 in the following. However, the present invention is not limited to this.

The compound RCTM-27 is synthesized according to the steps A to D described below.

(Step A)

The reaction was done in the same manner as described in paragraph [0073] of JP-A 2000-275887. Into a 100 mL flask equipped with an argon gas introducing device and a stirrer were placed 2.5 g of t-BuOK and 150 mL of DMF (N,N-dimethylformamide). The inside of the flask was made to be an argon gas atmosphere.

To this flask were added 5.0 g of compound (1) and 9.0 g of compound (9), and the mixture was stirred at room temperature for 1 hour.

Then the reaction mixture was poured into an excessive amount of water. Then the aqueous mixture was extracted with toluene. After washing the extraction liquid with water, the toluene solution was dried with sodium sulfate. Then, the toluene solution was concentrated and purified with column chromatography to obtain 10.6 g of compound (3).

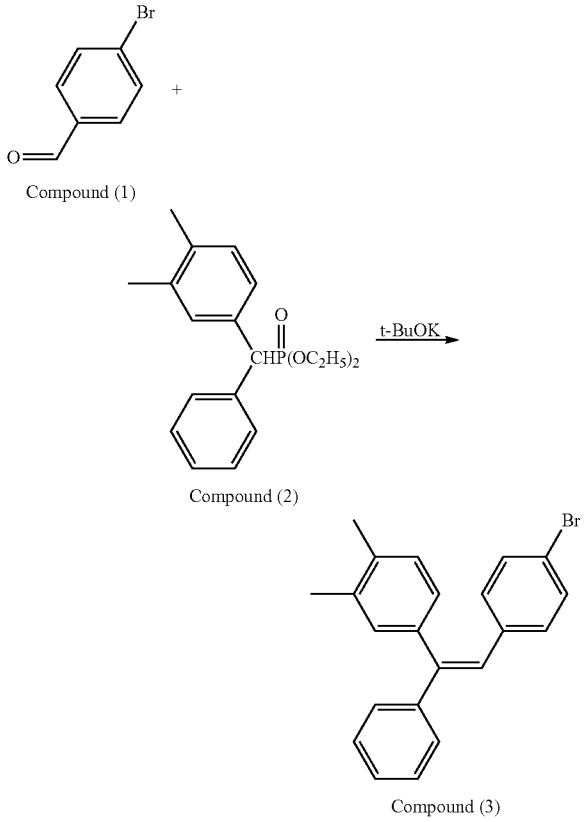

(Step B)

The reaction was done in the same manner as described in paragraph [0171] of JP-A 2013-254136. Into a four necked flask equipped with a cooling tube under a nitrogen gas atmosphere 0.37 g (1.6 mmol) of palladium acetate and 1.33 g (6.6 mmol) of tri-t-butyl phosphine were placed, and the mixture was stirred at room temperature for 30 minutes. Then, 3.51 g (32.8 mmol) of compound (4), 7.99 g (22 mmol) of compound (3), 20 mL of toluene, and 6.29 g (65.5 mmol) of sodium t-butoxide were added to the mixture. The mixture was heated to reflux for 2 hours. After cooling the mixture, 100 mL of water was added, and the mixture was stirred for 10 minutes. Then, the organic layer was washed with water until the moment of getting neutral washed water. The organic layer was dried with sodium sulfate, then, toluene was removed.

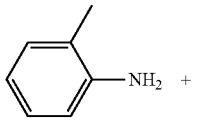

Compound (4)

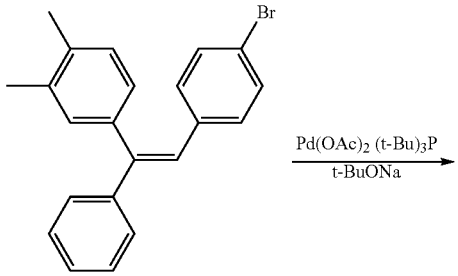

Compound (3)

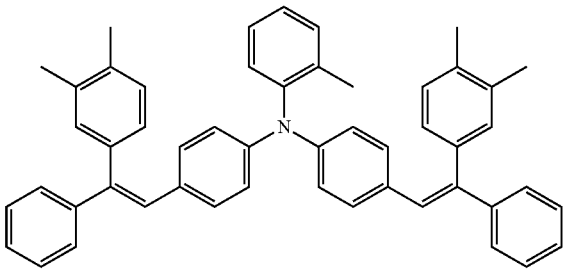

Compound (5)

(Step C)

The reaction was done in the same manner as described in paragraph [0072] of JP-A 2000-275887. A 100 mL flask equipped with a thermometer, a dropping funnel, an argon gas introducing device, and a stirrer was made to be under an argon gas atmosphere. Into this flask were placed 7 g of compound (5) obtained in the step B, 50 mL of toluene, and 3 g of phosphoryl chloride. While stirring the mixture at room temperature, 2 g of DMF was dropped gradually. Then the mixture was heated to about 80° C., and it was stirred for 16 hours. After pouring the reaction mixture into water of about 70° C., it was cooled. The aqueous solution was extracted with toluene. The extraction liquid was washed until the moment of getting the washed water of pH 7. The organic layer was dried with sodium sulfate. Then, the toluene solution was concentrated and purified with column chromatography to obtain 5 g of compound (6).

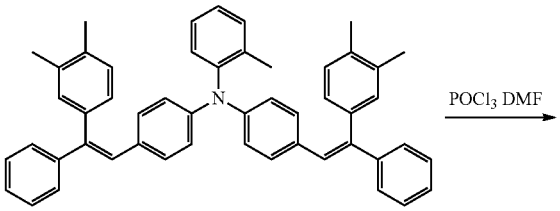

Compound (5)

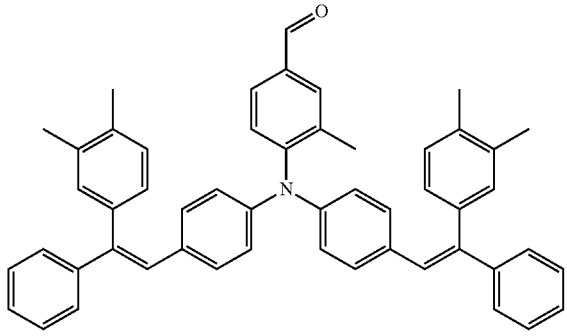

Compound (6)

(Step D)

The reaction was done in the same manner as described in paragraph [0068] of JP-A 2000-275887. 35.1 g of compound (6) and 100 mL of ethanol were placed in a 100 mL flask, then the mixture was stirred. To this mixture was gradually added 1.9 g of sodium borohydride. Then the liquid temperature was kept at 40 to 60° C., and it was stirred for about 2 hours. Afterward, the reaction liquid was gradually poured into 300 mL of water. The aqueous liquid was stirred to precipitate crystals. The obtained crystals were filtered and fully washed with water to obtain compound (7). The yield was 33 g.

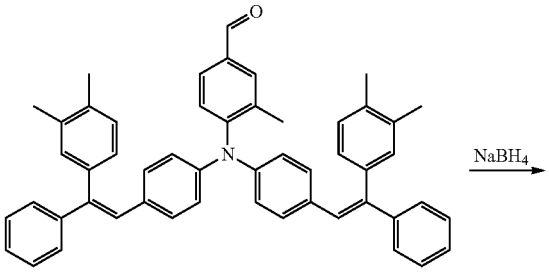

Compound (6)

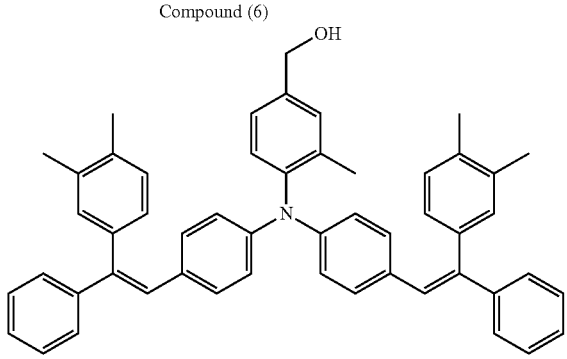

Compound (7)

Then, a mixture of the compound (7) dissolved in 50 mL of dichloromethane, 2 equivalent amount of triethylamine, and a catalytic amount of DMAP (dimethylaminopyridine) was cooled to 0° C. To this mixture was gradually added 1.5 equivalent amount of acryl chloride. Afterward, the temperature of the mixture was gradually increased, and it was stirred for 24 hours. This reaction solution was poured into 100 mL of water. Then the aqueous solution was extracted with dichloromethane. The extraction liquid was washed with a saturated aqueous solution of sodium hydrogen carbonate. The obtained organic layer was dried with magnesium sulfate, then, the solvent was removed. The obtained mixture was purified with column chromatography using a mixture of ethyl acetate and hexane mixture (=3:1) as an eluant. Thus, RCTM-27 was obtained. This is a methacrylate monomer.

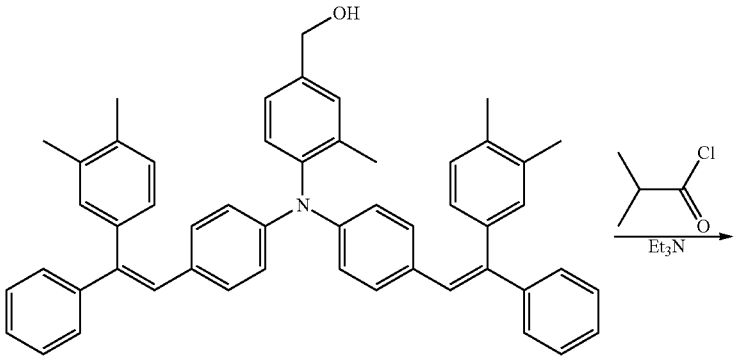

Compound (7)

(3.4) Other Charge Transport Agent

As described above, the protective layer may further contain other charge transport agent, in addition to the charge transport agent relating to the present invention that has a radical polymerizable functional group, has a maximum absorption wavelength in the range of 405±50 nm, and satisfies Formula (A). In that case, a content of the charge transport agent relating to the present invention is preferably 50 volume % or more to the total charge transport agent contained in the protective layer. More preferably, it is 70 volume % or more.

As other charge transport agent which may be contained in the protective layer, it is cited a compound that has a maximum absorption wavelength in the range of 405±50 nm, and satisfies Formula (A), but has not a radical polymerizable functional group in the molecule.

Examples of such compound are indicated in the following.

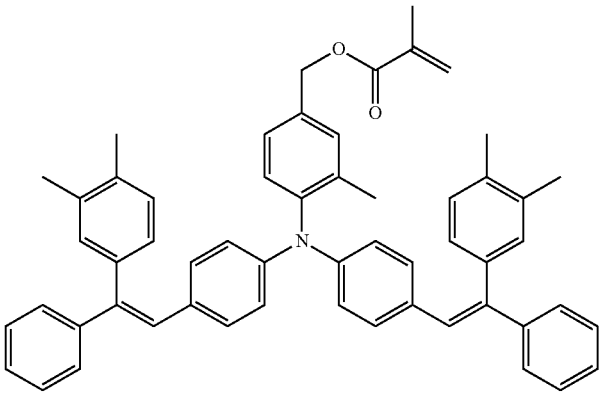

RCTM-27

| Compound | Structure |
|---|---|
| CTM-1 | 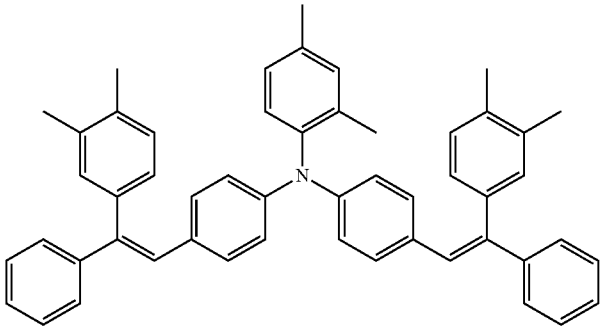 |
| CTM-2 | 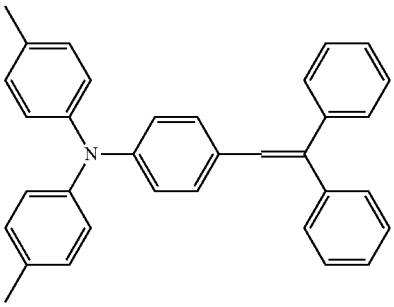 |
| CTM-3 | 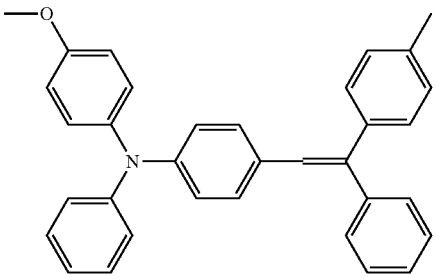 |
| CTM-4 | 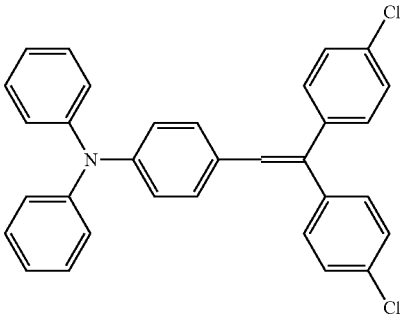 |
| CTM-5 | 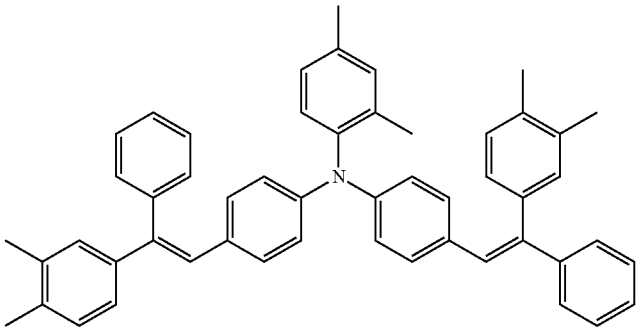 |

-continued
| Compound | Structure |
|---|---|
| CTM-141 | 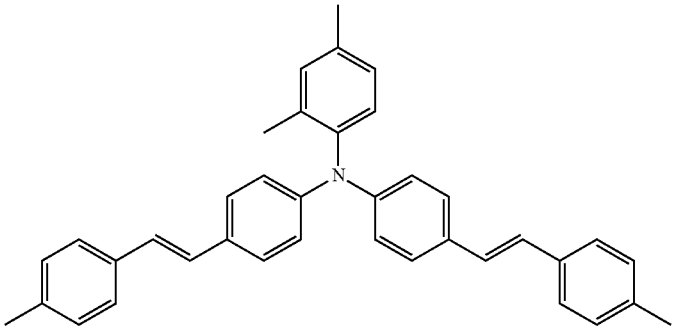 |
| CTM-143 | 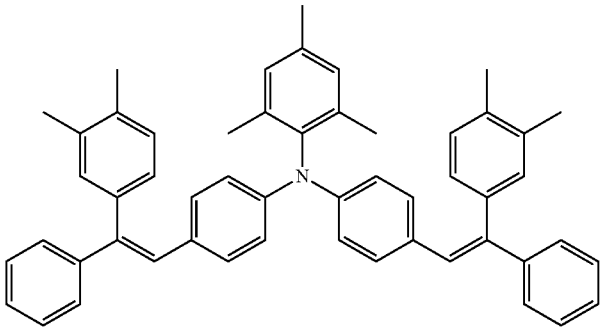 |
| CTM-144 | 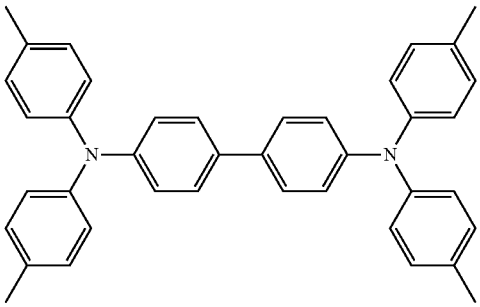 |
| CTM-145 | 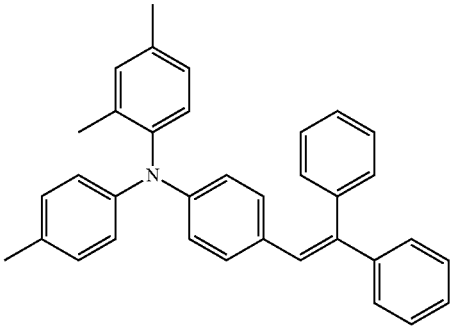 |
| CTM-146 | 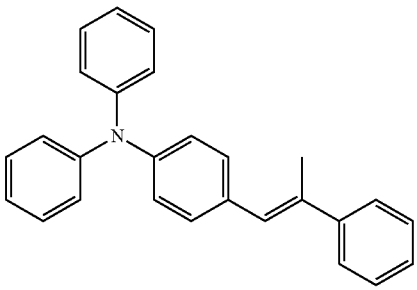 |

-continued

| Compound | Structure |
|---|---|
| CTM-147 | 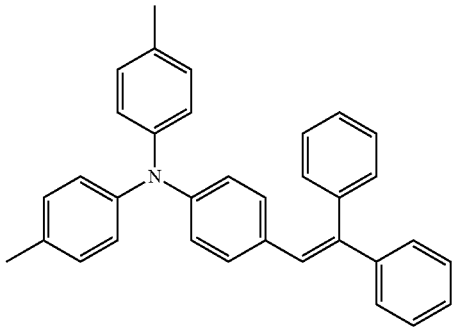 |

These charge transport agents may be synthesized with the method described in JP-A 2006-143720, for example.

The molecular weights of these charge transport agents are described with the figures having two significant digits after the decimal points.

As the other charge transport agent which may be contained in the protective layer, it is cited a compound that has a radical polymerizable functional group in the molecule, satisfies Formula (A), but has not a maximum absorption wavelength in the range of 405±50 nm. Examples of such charge transport agent are indicated in the following.

RCTM-26

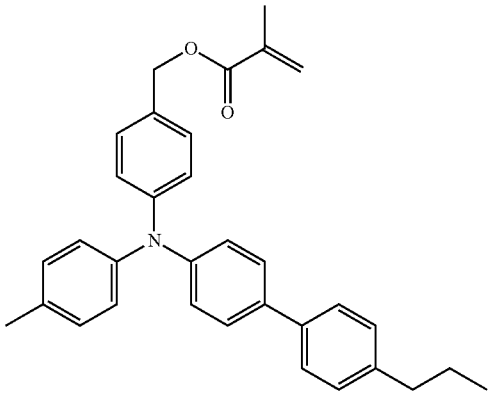

As the other charge transport agent which may be contained in the protective layer, it is cited a known charge transport agent that is contained in the protective layer of the electrophotographic photoreceptor.

(4) Inorganic Particles

The protective layer of the present invention preferably contains inorganic particles. It is more preferable that the inorganic particles are metal oxide particles.

As metal oxide particles, metal oxide minute particles including transition metals are preferable. Examples thereof are metal oxide minute particles of: silica (silicon oxide), magnesium oxide, zinc oxide, lead oxide, aluminum oxide (alumina), tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide, and vanadium oxide. Among them, preferable is one selected form the group consisting of tin oxide minute particles, titanium oxide minute particles, zinc oxide minute particles, and alumina minute particles from the viewpoint of improving abrasion resistance of the protective layer.

The above-described metal oxide particles are preferably produced with a known method such as: a gas phase method, a chlorine method, a sulfuric acid method, and a plasma method.

The above-described metal oxide particles preferably have a number average primary particle size in the range of 1 to 300 nm, for example, more preferably in the range of 3 to 100 nm.

An added ratio of the metal oxide particles is preferably in the range of 1 to 250 mass parts to 100 mass parts of the radical polymerizable compound for a binder, more preferably in the range of 10 to 200 mass parts.

(4.1) Measuring Method of Metal Oxide Particles

The particle size (the number average primary particle size) of the metal oxide particles is determined as follows. The particles are photographed at a magnification of 10,000 with a scanning electron microscope (manufactured by JEOL Ltd.), and the photographic image including randomly selected 300 particles (excluding agglomerated particles) of the metal oxide particles read by a scanner is converted into a binary image with an automatic image analyzer ("LUZEX AP" with software version Ver. 1.32, manufactured by NIRECO Corporation). The horizontal Feret's diameters of the metal oxide particles are calculated, and the average value of the Feret's diameters is defined as the number average primary particle size. Here, the "horizontal Feret's diameter" refers to the length of a side (parallel to the x-axis) of a circumscribed rectangle when an image of the metal oxide particles is subjected to a binary treatment.

(4.2) Surface Treatment

In the present invention, it is preferable that metal oxide particles have a reactive organic group. It is more preferable that metal oxide particles are surface-treated with a surface treating agent having a reactive organic group to have high dispersibility and enhance abrasion resistance of the photoreceptor.

The surface treating agents preferably used are those reactive with hydroxy groups present in the surface of the untreated metal oxide particles. Examples of such surface treating agents include silane coupling agents and titanium coupling agents.

Preferred in the present invention are surface treating agents having reactive organic groups to further increase the hardness of the protective layer. More preferred are those having radically polymerizable reactive organic groups. In binder resins for a protective layer containing curable resins including the following polymerizable compounds, such a surface treating agent having a radically polymerizable reactive organic group can also react with the polymerizable compounds to form firm protective layers.

Preferred surface treating agents having radically polymerizable reactive organic groups are silane coupling agents having acryloyl or methacryloyl groups. Examples of the surface treating agent having a radically polymerizable reactive organic group include the following known compounds.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Besides compounds S-1 to S-36, silane compounds having reactive organic groups which enable a radical polymerization reaction may also be used as the surface treating agent. These surface treating agents may be used alone or in combination.

The surface treating agent may be used in any amount, and is preferably used in an amount of 0.1 to 100 mass parts relative to 100 mass parts of the untreated metal oxide particles.

(4.3) Surface Treatment Process of Metal Oxide Particles

The metal oxide particles may be surface-treated as follows: a slurry containing an untreated metal oxide particles and a surface treating agent (suspension of solid particles) is wet milled to pulverize the metal oxide particles and simultaneously modify the surface of the metal oxide particles. The solvent is then removed to recover powder.

A preferred slurry is a mixture including 0.1 to 100 mass parts of surface treating agent and 50 to 5000 mass parts of solvent mixed with 100 mass parts of untreated metal oxide particles.

Examples of the apparatus used for wet pulverization of the slurry include wet medium dispersers.

A typical wet disperser operates as follows: a container of the wet medium disperser is filled with beads as dispersion media, and a stirring disk attached vertical to the rotary shaft is rotated at a high speed to pulverize and disperse aggregates of the metal oxide particles. The wet medium disperser may have any configuration which enables sufficient dispersion of the metal oxide particles and the surface treatment of the metal oxide particles at the same time during the surface treatment of the metal oxide particles. For example, usable wet medium dispersers may be of a variety of types, such as vertical, horizontal, continuous, and batch types. Specific examples of the usable wet disperser include: a sand mill, an Ultra Visco mill, a pearl mill, a grain mill, a Dyno mill, an agitator mill, and a dynamic mill. These dispersers pulverize and disperse particles by impact pressure, friction, shear, and shear stress of grinding media, such as balls and beads.

Examples of beads used in the wet medium disperser include balls composed of glass, alumina, zircon, zirconia, steel, and flint. Particularly preferred are zirconia and zircon beads. Although beads having a diameter of about 1 to 2 mm are usually used, those having a diameter of about 0.1 to 1.0 mm are preferably used in the present invention.

Although the wet medium disperser may include the disk and the inner wall of the container composed of a variety of materials, such as stainless steel, nylon, and ceramics, particularly preferred materials for the disk and the inner wall of the container in the present invention are ceramics, such as zirconia or silicon carbide.

(5) Other Additives

A protective layer of the present invention may contain other components other than a radial polymerizable compound for a binder (binder resin), a charge transport agent, a photopolymerization initiator, and inorganic particles. Various kinds of anti-oxidants, and various kinds of lubricant particles may be added. Examples of fluorine atom-containing resins particles include: a tetrafluoroethylene resin, a trifluorochloroethylene resin, a hexafluorochloroethylene-propylene resin, a vinyl fluoride rein, a vinylidene fluoride resin, and a difluorodichloroethylene resin. These polymers may be used alone or in combination. Among these resins, particularly preferred are a tetrafluoroethylene resin and a vinylidene fluoride resin.

<<Conductive Support>>

The conductive support may be composed of any material having conductivity. Examples of the material include: metals, such as aluminum, copper, chromium, nickel, zinc, and stainless steel, in the form of a drum or a sheet; laminates of plastic films and metal foils of aluminum or copper; plastic films on which aluminum, indium oxide, or tin oxide is deposited; and metals, plastic films, and papers having conductive layers disposed thereon through application of a single conductive substance or a combination thereof with a binder resin.

<<Intermediate Layer>>

In the electrophotographic photoreceptor of the present invention, it may be formed an intermediate layer that functions as a barrier between the conductive support and the photoreceptive layer. Such an intermediate layer is preferably disposed to prevent a variety of failures.

Such an intermediate layer contains a binder resin (hereinafter, also referred to as "a binder resin for an intermediate layer"), and optional conductive particles or metal oxide particles, for example.

Examples of the binder resin for an intermediate layer include casein, poly(vinyl alcohol), nitrocellulose, ethylene-acrylic copolymers, polyamide resins, polyurethane resins, and gelatin. Among these resins, preferred are alcohol-soluble polyamide resins.

The intermediate layer may contain a variety of conductive particles or metal oxide particles to have suitable resistance. A variety of metal oxide particles, such as alumina, zinc oxide, titanium oxide, tin oxide, antimony oxide, indium oxide, and bismuth oxide particles may be used. Ultrafine particles of tin-doped indium oxide and antimony-doped tin oxide and zirconium oxide may also be used.

These metal oxide particles have a number average primary particle size of preferably 0.3 μm or less, more preferably 0.1 μm or less.

These metal oxide particles may be used alone or in combination. A combination of these metal oxide particles may be in the form of a solid solution or a fused product.

The content of the conductive particles or the metal oxide particles is preferably in the range of 20 to 400 mass parts, more preferably in the range of 50 to 350 mass parts relative to 100 mass parts of the binder resin for an intermediate layer.

The thickness of the intermediate layer is preferably in the range of 0.1 to 15 μm, more preferably in the range of 0.3 to 10 μm.

<<Charge Generating Layer>>

The charge generating layer includes a charge generating material and a binder resin (hereinafter, also referred to as "a binder resin for a charge generating layer").

Examples of the charge generating material include, but should not be limited to, azo pigments, such as Sudan red and Dian blue; quinone pigments, such as pyrenequinone and anthanthrone; quinocyanine pigments; perylene pigments; indigo pigments, such as indigo and thioindigo; polycyclic quinone pigments, such as pyranthrone and diphthaloylpyrene; and phthalocyanine pigments. Among these charge generating materials, preferred are polycyclic quinone pigments and titanyl phthalocyanine pigments.

These charge generating materials may be used alone or in combination of two or more kinds.

Any known resin may be used as the binder resin for a charge generating layer. Examples of such a resin include, but should not be limited to, polystyrene, polyethylene, polypropylene, acrylic, methacrylic, poly(vinyl chloride), poly(vinyl acetate), poly(vinyl butyral), epoxy, polyurethane, phenol, polyester, alkyd, polycarbonate, silicone, and melamine resins, copolymer resins containing two or more of these resins (such as vinyl chloride-vinyl acetate copolymer resins and vinyl chloride-vinyl acetate-maleic anhydride copolymer resins), and poly(vinyl carbazole) resins. Among these resins, preferred are poly(vinyl butyral) resins.

The content of the charge generating material in the charge generating layer is preferably in the range of 1 to 600 mass parts, more preferably in the range of 50 to 500 mass parts relative to 100 mass parts of the binder resin for a charge generating layer.

Although the thickness of the charge generating layer is varied according to the characteristics of the charge generating material, those of the binder resin for a charge generating layer, and the contents thereof, the thickness is preferably in the range of 0.01 to 5 μm, more preferably in the range of 0.05 to 3 μm.

<<Charge Transport Layer>>]

The charge transport layer includes a charge transport material and a binder resin (hereinafter, also referred to as "a binder resin for a charge transport layer").

Examples of the charge transport material contained in the charge transport layer include triphenylamine derivatives, hydrazone compounds, styryl compounds, benzidine compounds, and butadiene compounds.

A known resin may be used as the binder resin for a charge transport layer. Examples of such a known resin include polycarbonate resins, polyacrylate resins, polyester resins, polystyrene resins, styrene-acrylonitrile copolymer resins, polymethacrylate resins, and styrene-methacrylate copolymer resins. Preferred are polycarbonate resins. Also preferred are polycarbonate resins of a bisphenol A (BPA) type, a bisphenol Z (BPZ) type, a dimethyl BPA type, and a BPA-dimethyl BPA copolymer type in view of crack resistance, abrasion resistance, and charging characteristics.

The content of the charge transport material in the charge transport layer is preferably in the range of 10 to 500 mass parts, more preferably in the range of 20 to 250 mass parts relative to 100 mass parts of the binder resin for a charge transport layer.

Although the thickness of the charge transport layer is varied according to the characteristics of the charge transport material, those of the binder resin for a charge transport layer, and the contents thereof, the thickness is preferably in the range of 5 to 40 μm, more preferably in the range of 10 to 30 μm.

The charge transport layer may contain an antioxidant, an electron conductive agent, a stabilizer, and silicone oil. Preferred antioxidants are those disclosed in Japanese Patent Application Laid-Open No. 2000-305291, and preferred electron conductive agents are those disclosed in Japanese Patent Application Laid-Open Nos. 50-137543, and 58-76483.

<Production Method of Electrophotographic Photoreceptor>

A production method of electrophotographic photoreceptor of the present invention is a method of producing an electrophotographic photoreceptor containing a conductive support laminated thereon a photosensitive layer and a protective layer in that order. The method contains a step of forming a protective layer by irradiating a composition having a radical polymerizable compound for a binder, a charge transport agent having a radical polymerizable functional group, and a photopolymerization initiator with UV rays to cure. It is characterized in that the charge transport agent having a radical polymerizable functional group has a maximum absorption wavelength in the range of 405±50 nm, and the charge transport agent having a radical polymerizable functional group and the photopolymerization initiator satisfy Formula (A).

Here, in the present invention, UV rays are an electromagnetic wave having a wavelength of 10 to 400 nm.

An example of the production method of electrophotographic photoreceptor of the present invention contains the following steps.

Step (1): a step of forming an intermediate layer by applying a coating liquid for forming an intermediate layer to an outer peripheral surface of a conductive support, followed by drying the intermediate layer.

Step (2): a step of forming a charge generating layer by applying a coating liquid for forming a charge generating layer to an outer peripheral surface of the intermediate layer formed on the conductive support, followed by drying the charge generating layer.

Step (3): a step of forming a charge transport layer by applying a coating liquid for forming a charge transport layer to an outer peripheral surface of the charge generating layer formed on the intermediate layer, followed by drying the charge transport layer.

Step (4): a step of forming a protective layer by applying a coating liquid for forming a protective layer to an outer peripheral surface of the charge transport layer formed on the charge generating layer, followed by irradiating with UV rays to cure the protective layer.

Each step will be described in the following.

(Step (1): Forming an Intermediate Layer)

The intermediate layer may be formed with the following method, for example. A binder resin for an intermediate layer is dissolved in a solvent to prepare a coating liquid (hereafter, it may be called as "a coating liquid for forming an intermediate layer"). Subsequently, according to necessity, conductive particles or metal oxide particles are dispersed in this liquid. This coating liquid is applied on a conductive support with a predetermined thickness to obtain a coated layer. The intermediate layer may be formed by drying this coated layer.

As a dispersing method for dispersing conductive particles or metal oxide particles into a coating liquid for forming an intermediate layer, it may be cited: an ultrasonic disperser, a ball mill, a sand mill, and a homo mixer. However, the dispersing method is not limited to these.

As a coating method of a coating liquid for forming an intermediate layer, it may be cited known methods such as: a dip coating method, a spray coating method, a spinner coating method, a bead coating method, a blade coating method, a beam coating method, and a slide hopper method.

A drying method of the coated layer may be suitably selected from the known drying methods according to the kinds of solvent and the thickness of the layer. A heat drying method is preferably used.

As a solvent used for forming an intermediate layer, it is sufficient that it will dissolve the binder resin for the intermediate layer, and it will give a good dispersion property for the conductive particles or the metal oxide particles. Examples of a preferable solvent are alcohols with 1 to 4 carbon atoms such as: methanol, ethanol, n-propyl alcohol, isopropyl alcohol, n-butanol, t-butanol, and sec-butanol. These are preferably used from the viewpoint of solubility of the binder resin and coating property. In order to increase the storage stability and the dispersion property of the particles, it may be used an auxiliary solvent. Examples of an auxiliary solvent which may be used with the above-described solvent and may give a good effect are: benzyl alcohol, toluene, dichloromethane, cyclohexanone, and tetrahydrofuran.

A content of the binder resin for an intermediate layer in the coating liquid for forming an intermediate layer may be suitably selected in accordance with the layer thickness of the intermediate layer and the production speed.

(Step (2): Forming a Charge Generating Layer)

The charge generating layer may be formed with the following method, for example. A charge generating material is dispersed into a solution of a binder resin for a charge generating layer dissolved in a solvent to obtain a coating liquid (hereafter, it may be called as "a coating liquid for forming a charge generating layer"). This coating liquid is applied on the intermediate layer with a predetermined thickness to obtain a coated layer. The charge generating layer may be formed by drying this coated layer.

As a dispersing method for dispersing charge generating material into a coating liquid for forming a charge generating layer, it may be cited: an ultrasonic disperser, a ball mill, a sand mill, and a homo mixer. However, the dispersing method is not limited to these.

As a coating method of a coating liquid for forming a charge generating layer, it may be cited known methods such as: a dip coating method, a spray coating method, a spinner coating method, a bead coating method, a blade coating method, a beam coating method, and a slide hopper method.

A drying method of the coated layer may be suitably selected from the known drying methods according to the kinds of solvent and the thickness of the layer. A heat drying method is preferably used.

Examples of a solvent used for formation of the charge generating layer include: toluene, xylene, dichloromethane, 1,2-dichloroethane, methyl ethyl ketone, cyclohexane, ethyl acetate, t-butyl acetate, methanol, ethanol, propanol, butanol, methyl cellosolve, 4-methoxy-4-methyl-2-pentanone, ethyl cellosolve, tetrahydrofuran, 1,4-dioxane, 1-dioxolane, pyridine, and diethylamine. The solvent is not limited to them.

(Step (3): Forming a Charge Transport Layer)

The charge transport layer may be formed with the following method, for example. A binder resin for a charge transport layer and a charge transport material are dissolved in a solvent to obtain a coating liquid (hereafter, it may be called as "a coating liquid for forming a charge transport layer"). This coating liquid is applied on the charge generating layer with a predetermined thickness to obtain a coated layer. The charge transport layer may be formed by drying this coated layer.

As a coating method of a coating liquid for forming a charge transport layer, it may be cited known methods such as: a dip coating method, a spray coating method, a spinner coating method, a bead coating method, a blade coating method, a beam coating method, and a slide hopper method.

A drying method of the coated layer may be suitably selected from the known drying methods according to the kinds of solvent and the thickness of the layer. A heat drying method is preferably used.

Examples of a solvent used for formation of the charge transport layer include: toluene, xylene, dichloromethane, 1,2-dichloroethane, methyl ethyl ketone, cyclohexane, ethyl acetate, butyl acetate, methanol, ethanol, propanol, butanol, tetrahydrofuran, 1,4-dioxane, 1,3-dioxolane, pyridine, and diethylamine. The solvent is not limited to them.

(Step (4): Forming a Protective Layer)

A protective layer relating to the present invention is formed as follows. A composition having a radical polymerizable compound for a binder, a charge transport agent having a radical polymerizable functional group exhibiting a maximum absorption wavelength in the range of 405±50 nm, and a photopolymerization initiator is irradiated with UV rays to cure. The charge transport agent and the photopolymerization initiator satisfy Formula (A).

Specifically, a coating liquid is prepared by adding: a radical polymerizable compound for a binder, a charge transport agent having a radical polymerizable functional group exhibiting a maximum absorption wavelength in the range of 405±50 nm, and a photopolymerization initiator, and according to necessity, inorganic particles and other component into a known solvent (hereafter, this coating liquid is called as "a coating liquid for forming a protective layer"). Then, this coating liquid is applied to an outer peripheral surface of the charge transport layer formed in the step (3) to obtain a coated layer. This coated layer is dried and irradiated with UV rays to cure the radical polymerizable compound for a binder in the coated layer. Thus, a protective layer is obtained.

In the curing treatment of the protective layer, it is preferable to make polymerization via generation of a radical by irradiating the coated layer with UV rays, and to polymerize the radical polymerizable compound for a binder, and a charge transport agent having a radical polymerizable functional group with forming a cross-linking bond by cross-linking reaction of intra and inter molecules, to result in forming a cross-linked binder resin of the radical polymerizable compound for a binder.

In the coating liquid for forming a protective layer, it is preferable that the content of the inorganic particles is in the range of 5 to 60 volume parts to 100 volume parts of the radical polymerizable compound for a binder, more preferably, the content is in the range of 10 to 60 volume parts.

It is preferable that the charge transport material is contained in the range of 5 to 75 volume parts to 100 volume parts of the radical polymerizable compound for a binder, more preferably, it is contained in the range of 5 to 50 volume parts.

It is preferable that the photopolymerization initiator is contained in the range of 0.1 to 20 mass parts to 100 mass parts of the radical polymerizable compound for a binder, more preferably, it is contained in the range of 0.5 to 10 mass parts.

As a dispersing method for dispersing the inorganic particles and the charge transport material into a coating liquid for forming protective layer, it may be cited: an ultrasonic disperser, a ball mill, a sand mill, and a homo mixer. However, the dispersing method is not limited to these.

Any solvent may be used as a solvent for forming a protective layer as long as it can dissolve or disperse a radical polymerizable compound for a binder, a charge transport agent, a photopolymerization initiator, and inorganic particles. Examples thereof include: methanol, ethanol, n-propyl alcohol, isopropyl alcohol, n-butanol, t-butanol, and sec-butanol, benzyl alcohol, toluene, xylene, dichloromethane, methyl ethyl ketone, cyclohexane, ethyl acetate, butyl acetate, methyl cellosolve, ethyl cellosolve, tetrahydrofuran, 1,4-dioxane, 1,3-dioxolane, pyridine, and diethylamine. The solvent is not limited to them.

As a coating method of a coating liquid for forming a protective layer, it may be cited known methods such as: a dip coating method, a spray coating method, a spinner coating method, a bead coating method, a blade coating method, a beam coating method, and a slide hopper method.

Although a curing treatment may be performed to the coated layer without drying, it is preferable that a curing treatment is performed to the coated layer after subjecting it to natural drying or heat drying.

The drying conditions of the coated layer are suitably selected depending on the kind of solvent used in the coating liquid or the thickness of the coated layer. The drying temperature is preferably in the range of room temperature (25° C.) to 180° C., more preferably, it is in the range of 80 to 140° C. The drying time is preferably 1 to 200 minutes, more preferably, it is 5 to 100 minutes.

It may be used any light source as a UV ray source as long as it generates UV rays. Examples of a UV source include: a low-pressure mercury lamp, a middle-pressure mercury lamp, a high-pressure mercury lamp, an ultrahigh-pressure mercury lamp, a carbon-arc lamp, a metal halide lamp, a xenon lamp, and a flash (pulsed) xenon lamp. The conditions of emitting light may vary depending on the type of the lamp. The dose of UV rays is usually in the range of 5 to 500 $mJ/cm^2$, preferably it is in the range of 5 to 100 $mJ/cm^2$. The output power of the light source is preferably in the range of 0.1 to 5 kW, particularly preferably, it is in the range of 0.5 to 3 kW.

The irradiation time to obtain a necessary amount of irradiation of UV rays is preferably 0.1 seconds to 10 minutes. From the viewpoint of operation efficiency, more preferable time is 0.1 seconds to 5 minutes.

In the step of forming a protective layer, the coated layer may be subjected to a drying treatment before or after, or during the irradiation with UV rays. The timing to perform the drying treatment may be suitably selected by combining the irradiating conditions.

<<Image-Forming Apparatus>>

An image-forming apparatus of the present invention is provided with the above-described electrophotographic photoreceptor. Preferably, the image-forming apparatus of the present invention is provided with: a first a charging unit to charge a surface of the electrophotographic photoreceptor; an exposing unit to form an electrostatic latent image on the surface of the electrophotographic photoreceptor; a developing unit to develop the electrostatic latent image with a toner into a toner image; a transferring unit to transfer the toner image on a transfer medium; a second charging unit to charge a surface of the electrophotographic photoreceptor after transferring the toner image on the transfer medium; and a cleaning unit to remove the residual toner on the electrophotographic photoreceptor.

Figure 2:
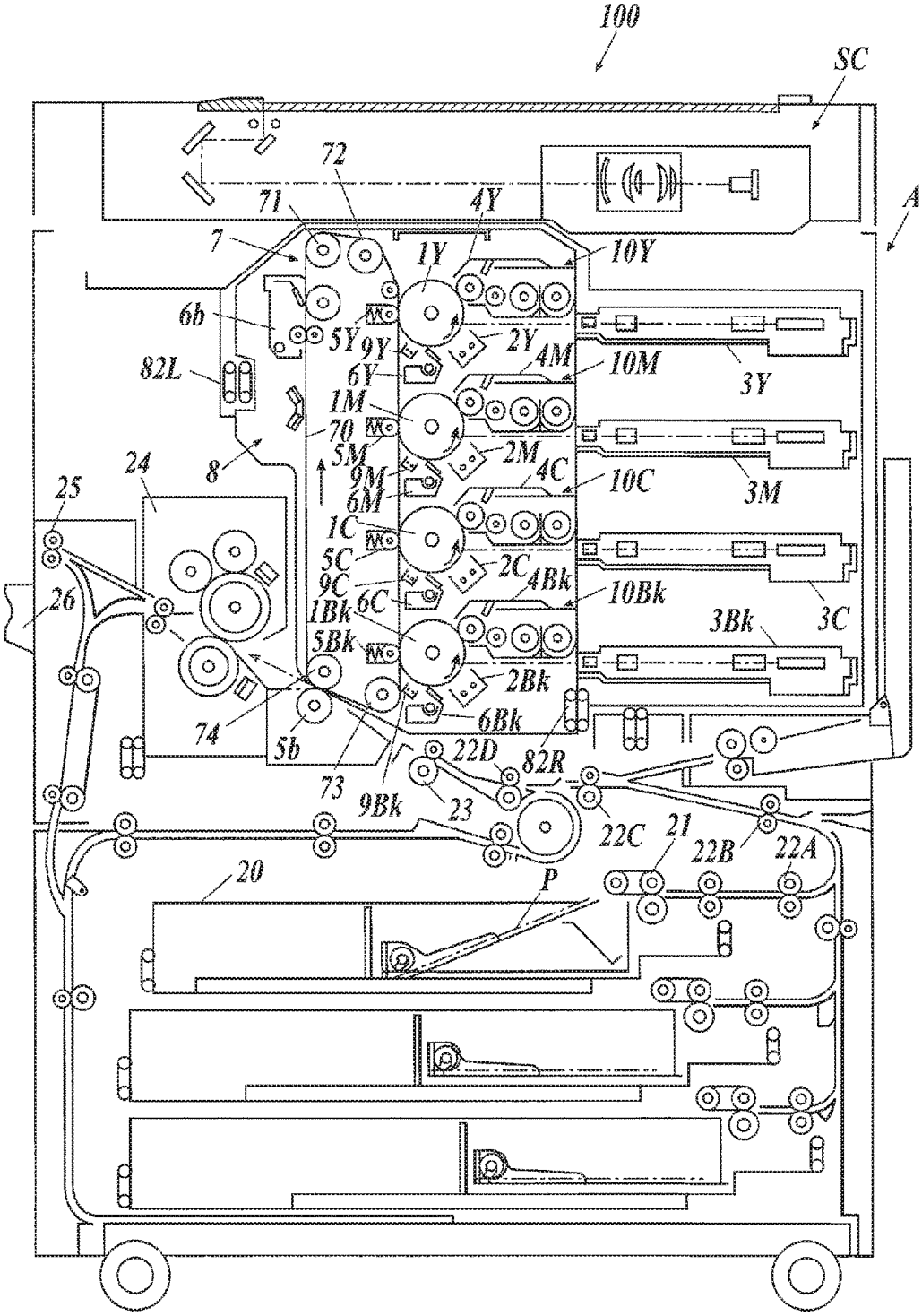
FIG. 2 is a schematic configuration drawing illustrating an example of an image-forming apparatus equipped with an electrophotographic photoreceptor of the present invention

FIG. 2 is a schematic configuration diagram illustrating an example of an image-forming apparatus of the present invention.

An image-forming apparatus 100 is called as a tandem color image-forming apparatus, and it includes four image-forming units 10Y, 10M, 10C, and 10Bk, an intermediate transferring unit 7 having an endless belt form, a sheet feeding unit 21, and a fixing unit 24. The image-forming apparatus 100 further includes a document scanner SC above a body A of the image-forming apparatus.

The image-forming unit 10Y that forms a yellow image includes a drum photoreceptor 1Y, and in the rotation order of the photoreceptor 1Y around the photoreceptor 1Y, there are located: a first charging unit 2Y, an exposing unit 3Y, a developing unit 4Y, a primary transfer roller 5Y, a second charging unit 9Y, and a cleaning unit 6Y.

The image-forming unit 10M that forms a magenta image includes a drum photoreceptor 1M, and in the rotation order of the photoreceptor 1M around the photoreceptor 1M, there are located: a first charging unit 2M, an exposing unit 3M, a developing unit 4M, a primary transfer roller 5M, a second charging unit 9M, and a cleaning unit 6M.

The image-forming unit 10C that forms a cyan image includes a drum photoreceptor 1C, and in the rotation order of the photoreceptor 1C around the photoreceptor 1C, there are located: a first charging unit 2C, an exposing unit 3C, a developing unit 4C, a primary transfer roller 5C, a second charging unit 9C, and a cleaning unit 6C.

The image-forming unit 10Bk that forms a black image includes a drum photoreceptor 1Bk, and in the rotation order of the photoreceptor 1Bk around the photoreceptor 1Bk, there are located: a first charging unit 2Bk, an exposing unit 3Bk, a developing unit 4Bk, a primary transfer roller 5Bk, a second charging unit 9Bk, and a cleaning unit 6Bk.

The electrophotographic photoreceptors of the present invention are used for the photoreceptors 1Y, 1M, 1C, and 1Bk.

The image-forming units 10Y, 10M, 10C, and 10Bk have the same configuration except for the colors of toner images formed on the photoreceptors 1Y, 1M, 1C, and 1Bk. Thus, the following description focuses on the image-forming unit 10Y as an example. The descriptions for the image-forming units 10M, 10C, and 10Bk are omitted.

The image-forming unit 10Y includes the first charging unit 2Y, the exposing unit 3Y, the developing unit 4Y, the primary transfer roller 5Y, the second charging unit 9Y, and the cleaning unit 6Y, which are disposed around the photoreceptor 1Y (image retainer). The image-forming unit 10Y forms a yellow (Y) toner image on the photoreceptor 1Y. In the present embodiment, among the members of the image-forming unit 10*y*, at least the photoreceptor 1Y, the first charging unit 2Y, the developing unit 4Y, the second charging unit 9Y, and the cleaning unit 6Y are installed in an integrated form.

The first charging unit 2Y provides the photoreceptor 1Y with a uniform electric potential. For example, the charger of corona discharge mechanism is employed.

The exposing unit 3Y exposes the photoreceptor 1Y provided with the uniform potential by the first charging unit 2Y in response to image signals (yellow) to form an electrostatic latent image corresponding to the yellow image. The exposing unit 3Y includes light-emitting devices (LEDs) arrayed in the axial direction of the photoreceptor 1Y and an imaging element, or includes a laser optical device.

The developing unit 4Y includes: a developing sleeve which includes a magnet and rotating with holding a developer; and a voltage applying device to apply a DC or AC bias voltage between the photoreceptor 1Y and this developing sleeve.

The primary transfer roller 5Y is a device to transfer the toner image formed in the photoreceptor 1Y to the intermediate transferring belt 70 in the endless-belt form. The primary transfer roller 5Y is arranged in such a manner to abut the intermediate transferring belt 70.

The second charging unit 9Y is a neutralization apparatus to charge (neutralize) the surface of the photoreceptor 1Y after transferring the toner image to the intermediate transferring belt 70. It is installed as a pre-cleaning member. For example, it is used a corona discharger as a second charging unit 9Y.

The image-forming apparatus 100 of the present invention is provided with an electrophotographic photoreceptor, and further, it is provided with a second charging unit 9Y. By this configuration, it is possible to obtain the photoreceptor having a sufficient long lifetime and a high quality image. Since the image-forming apparatus 100 is provided with an electrophotographic photoreceptor of the present invention, it is possible to obtain the photoreceptor having a sufficient long lifetime and a high quality image under the image-forming condition of without installed by a second charging unit 9Y or without using a second charging unit 9Y.

The cleaning unit 6Y includes: a cleaning blade; and a brush roller located in the upstream side of the cleaning blade, for example.

An intermediate transferring unit 7 having an endless belt form is wound by a plurality of rollers 71, 72, 73, and 74. It has an intermediate transferring belt 70 in the endless-belt form as a second image carrier of a semiconductor endless belt that is rotatably supported. The intermediate transferring unit 7 is disposed with a cleaning unit 6*b* that removes the toner on the intermediate transferring belt 70.

A housing 8 includes the above-described image-forming units 10Y, 10M, 10C, 10Bk, and intermediate transferring unit 7. The housing 8 has a structure which can be drawn from the apparatus body A via rails 82L and 82R.

As a fixing unit 24, it may be cited a heat-roller type fixing device including: a heat roller incorporating a heat source inside thereof; and a pressure roller which forms a nip portion at the heat roller in such a manner to abut the heat roller.

In FIG. 2, the image-forming apparatus 100 is illustrated as a color laser printer. However, the photoreceptor of the present invention may be applied similarly to a monochromatic laser printer, a copier, or a multifunction peripheral. Further, in this image-forming apparatus, a light source other than a laser, such as an LED light source, may be used as an exposing light source.

<<Image-Forming Method>>

An image-forming method of the present invention is characterized in using an electrophotographic photoreceptor of the present invention. Specifically, a toner image is formed by using the above-described image-forming apparatus 100 equipped with an electrophotographic photoreceptor of the present invention as described in the following.

At first, the surfaces of the photoreceptors 1Y, 1M, 1C, and 1Bk are negatively charged with the first charging units 2Y, 2M, 2C, and 2Bk. Subsequently, the surfaces of the photoreceptors 1Y, 1M, 1C, and 1Bk are exposed corresponding to the image signals by the exposing units 3Y, 3M, 3C, and 3Bk to form an electrostatic latent image. Then, the toners are given to the surface of the photoreceptors 1Y, 1M, 1C, and 1Bk by the developing unit 4Y, 4M, 4C, and 4Bk to develop the electrostatic latent image and to form a toner image of each color.

Then, the color toner images formed on the photoreceptors 1Y, 1M, 1C, and 1Bk are sequentially transferred onto the rotating intermediate transferring belt 70 with the respective first transferring rollers 5Y, 5M, 5C, and 5Bk, to form a synthesized color image on the intermediate transferring belt 70 (primary transfer).

The surfaces of the photoreceptors 1Y, 1M, 1C, and 1Bk are neutralized with the second charging unit 9Y, 9M, 9C, and 9Bk. Then, the toners remained on the photoreceptors 1Y, 1M, 1C, and 1Bk are removed with the cleaning units 6Y, 6M, 6C, and 6Bk. Afterward, the photoreceptors 1Y, 1M, 1C, and 1Bk are negatively charged with the charging units 2Y, 2M, 2C, and 2Bk for the next image-forming process.

On the other hand, a transfer medium P accommodated in a sheet feeding cassette 20 is fed by the sheet feeding unit 21, and it is transported to a second transferring roller 5*b* (second transferring unit) via multiple intermediate rollers 22A, 22B, 22C, and 22D and register rollers 23. A color image is transferred (second transfer) to the transfer medium P by the second transferring roller 5*b*.

The transfer medium P transferred with a color image is subjected to a fix treatment with the fixing unit 24. The transfer medium P is then pinched between discharging rollers 25 and is conveyed to a sheet receiving tray 26 provided outside of the apparatus. After separation of the transfer medium P from the intermediate transferring belt 70, the residual toner on the intermediate transferring belt 70 is removed by the cleaning unit 6*b*.

Thus, an image is formed on the transfer medium P.

Although embodiments of the present invention have been described and illustrated in detail, the disclosed embodiments are made for purposes of illustration and example only and not limitation. The scope of the present invention should be interpreted by terms of the appended claims.

EXAMPLE

Hereafter, the present invention will be described specifically by referring to examples, however, the present invention is not limited to them. In Examples, the term "parts" or "%" is used. Unless particularly mentioned, it represents "mass parts" or "mass %".

<<Preparation of Electrophotographic Photoreceptor 101>>

(Preparation of Conductive Support)

At first, a conductive support was prepared through milling of the surface of a cylindrical aluminum support having a diameter of 60 mm.

(Preparation of Intermediate Layer)

The dispersion liquid of the following composition was diluted with the same mixed solvent by a factor of 1.5 times. After leaving still the mixture for one night, it was filtered with Rigimesh™ filter (5 μm, made by Nihon Pall Ltd.) to obtain a coating liquid for forming an intermediate layer.

| | |
|---|---|
| Binder: Polyamide resin "CM 8000" (made by Toray Co. Ltd.) | 100 mass parts |
| Metal oxide particles: "SMT500SAS" (mad by TEIKA Co. Ltd.) | 120 mass parts |
| Metal oxide particles: "SMT150MK" (mad by TEIKA Co. Ltd.) | 155 mass parts |
| Solvent: Ethanol/n-PrOH/THF (volume ratio, 60:20:20) | 1,290 mass parts |

The obtained coating liquid for forming an intermediate layer was subjected to a dispersion treatment of a batch method with a sand mill for 5 hours.

The dispersed coating liquid for forming an intermediate layer was applied to a surface of a conductive support through dip coating. Subsequently, the coated layer was dried to obtain an intermediate layer having a thickness of 2 μm.

(Preparation of Charge Generating Layer)

A coating liquid for forming a charge generating layer was prepared through mixing of the following materials with a sand mill for 10 hours. The above-described liquid for forming a charge generating layer was applied onto the intermediate layer through dip coating, and the resultant film was dried to form a charge generating layer having a thickness of 0.3 μm.

| | |
|---|---|
| Charge generating material: Titanylphthalocyanine pigment (having at least a maximum diffraction peak at 27.3° as measured by Cu—Kα X-ray diffractometry) | 20 mass parts |
| Binder resin for charge generating layer: Poly(vinyl butyral) resin (#6000-C: made by Denka Co. Ltd.) | 10 mass parts |
| Solvent: t-Butyl acetate | 700 mass parts |
| Solvent: 4-Methoxy-4-methyl-2-pentanone | 300 mass parts |

(Preparation of Charge Transport Layer)

A coating liquid for forming a charge transport layer was prepared through mixing and dissolution of the following materials. The prepared coating liquid for forming a charge transport layer was applied onto the charge generating layer through dip coating, and the resultant film was dried to form a charge transport layer having a thickness of 20 μm. Thus, it was formed a photosensitive layer including a charge generating layer and a charge transport layer.

| | |
|---|---|
| Charge transport material: 4,4'-dimethyl-4''-(β-phenylstyryl)triphenylamine | 225 mass parts |
| Binder resin: Polycarbonate resin ("Z300", made by Mitsubishi Gas Chemical Co. Inc.) | 300 mass parts |
| Antioxidant: Irganox 1010 (made by BASF Japan Co. Ltd.) | 6 mass parts |
| Solvent: Tetrahydrofuran | 1,600 mass parts |
| Solvent: Toluene | 400 mass parts |
| Leveling agent: Silicone oil ("KF-54", made by Shin-Etsu Chemical Co., Ltd.) | 1 mass part |

(Preparation of Protective Layer)

A coating liquid for forming a protective layer was prepared by mixing with stirring the following materials to the extent of fully dissolving and dispersing the mixture. The obtained coating liquid for forming a protective layer was applied on the photosensitive layer with a circular slide hopper coating apparatus to form a coated layer. The coated layer was irradiated with UV rays (wavelength 365 nm) of a xenon lamp for 1 minute under the condition of lighting intensity of 100 mW/cm$^2$ measured with an illuminance meter UIT-201 (Ushio Inc.). Then the coated layer was dried at 110° C. for 70 minutes. Thus, it was formed a protective layer having a dry thickness of 3.0 μm. An electrophotographic photoreceptor 101 was thus produced.

| | |
|---|---|
| Radical polymerizable compound for binder: Exemplified compound M1 | 100 mass parts |
| Charge transport agent: Compound RCTM-1 | 43 mass parts |
| Photopolymerization initiator: Irgacure 819 (made by BASF Japan Co. Ltd.) | 10 mass parts |
| Solvent: 2-Butanol | 160 mass parts |
| Solvent: 2-Methyltetrahydrofuran | 160 mass parts |

<<Preparation of Electrophotographic Photoreceptor 102>>

An electrophotographic photoreceptor 102 was prepared in the same manner as preparation of the electrophotographic photoreceptor 101 except that the forming method of the protective layer was changed as described in the following.

In the first place, inorganic silica particles were subjected to a surface treatment so as to be given a reactive organic group as described below.

The following materials were mixed.

| | |
|---|---|
| Silica (number average primary particle size: 20 nm, made by Nippon Aerosil Co. Ltd.) | 100 mass parts |
| The surface modifying agent S-15 ($CH_2{=}C(CH_3)COO(CH_2)Si(OCH_3)_3$) | 30 mass parts |
| Mixed solvent: Toluene/isopropyl alcohol = 1/1, mass ratio) | 300 mass parts |

The above-described mixture was placed in a sand mill with zirconia beads, and they were stirred at about 40° C. with a rotation rate of 1,500 rpm. The stirred mixture was taken out and it was further placed in a Henschel mixer. Then the mixture was further stirred with a rotation rate of 1,500 rpm for 15 minutes. Then it was dried at 120° C. for 3 hours to obtain silica particles having been subjected to a surface treatment. The obtained silica particles having been subjected to a surface treatment were heated by increasing from 25° C. to 60° C. with Automatic TG/DTA measuring apparatus DYG-60A (Shimadzu Co.). A decreased mass amount of the silica particles was measured. It was confirmed that the surface of the silica particle was covered with the surface modifying agent S-15.

Then, a coating liquid for forming a protective layer was prepared by mixing and stirring the following materials to the extent of fully dissolving and dispersing the mixture. The obtained coating liquid for forming a protective layer was applied on the photosensitive layer with a circular slide hopper coating apparatus to form a coated layer. The coated layer was irradiated with UV rays (wavelength 365 nm) of a xenon lamp for 1 minute under the condition of lighting intensity of 100 mW/cm$^2$ measured with an illuminance meter UIT-201 (Ushio Inc. Then the coated layer was dried at 110° C. for 70 minutes. Thus, it was formed a protective layer having a dry thickness of 3.0 μm.

| | |
|---|---|
| Inorganic particles: The silica particles having been subjected to a surface treatment | 54 mass parts |
| Radical polymerizable compound for binder: Exemplified compound M1 | 100 mass parts |
| Charge transport agent: Compound RCTM-1 | 43 mass parts |
| Photopolymerization initiator: Irgacure TPO (made by BASF Japan Co. Ltd.) | 10 mass parts |
| Solvent: 2-Butanol | 160 mass parts |
| Solvent: 2-Methyltetrahydrofuran | 160 mass parts |

<<Preparation of Electrophotographic Photoreceptors 103 to 112>>

Electrophotographic photoreceptors 103 to 112 were prepared in the same manner as preparation of the electrophotographic photoreceptor 102 except that the kinds of the charge transport agent, the photopolymerization initiator, and the inorganic particles were changed as described in Table 1.

<<Evaluation methods of Electrophotographic Photoreceptor>>

The prepared electrophotographic photoreceptors as described above were subjected to the following evaluations. The evaluation results are listed in Table 1.

(1) Evaluation of Memory Resistive Property

An image-forming apparatus "bizhub PRESS C1070" (made by Konica Minolta, Inc.) was used as an evaluation apparatus. The prepared electrophotographic photoreceptors were each respectively loaded to that apparatus. An endurance test was conducted by continuously printing on both sides of 400,000 sheets with a character image having an image area ratio of 6% in the A4 sideway feed under the conditions of a temperature of 23° C. and a humidity of 50% RH.

After conducting the endurance test, 10 sheets of prints having an image including a solid black image and a solid white image were printed. Subsequently, a uniform halftone image was printed. The presence or the absence of a history effect (memory) of the solid black image and the solid white image in the halftone image was detected. The evaluation was done according to the following evaluation criteria.

◎: No generation of memory image (Good)

○: Memory image is visually confirmed only at the edge portion (Acceptable for practical use).

X: Generation of distinct memory image is confirmed (Not acceptable for practical use)

(2) Evaluation of Image Quality

After conducting the endurance test as done for the evaluation of memory resistive property, the prepared electrophotographic photoreceptors each were set as a photoreceptor in an image-forming unit for forming a black image. A black halftone image having an image density of 0.4 was printed on 100 sheets of A4 plain paper (64 g/m$^2$) under the conditions of low temperature and low humidity (a temperature of 10° C. and a humidity of 15% RH). The spots whose generation in the image on the prints correspond to the rotation cycle of the electrophotographic photoreceptor and can be visually observed were detected. The number of such spots was counted, and the evaluation was done according to the following evaluation criteria.

◎: The number of spots is 3 or less per sheet (Good)

○: The number of spots is 4 to 8 per sheet (Acceptable for practical use).

X: The number of spots is 9 or more per sheet (Not acceptable for practical use)

(3) Evaluation of Abrasion Resistance (a Value)

An image-forming apparatus "bizhub 1250" (made by Konica Minolta, Inc.) was used as an evaluation apparatus. The prepared electrophotographic photoreceptors were each respectively loaded to that apparatus.

An endurance test (abrasion resistance test) was conducted by continuously printing on both sides of 300,000 A4 sheets with a side-belt chart image having an image area ratio of 5% in the A4 sideway feed under the conditions of a temperature of 23° C. and a humidity of 50% RH.

The layer thickness of the electrophotographic photoreceptor before and after the endurance test was measured. The decreased amount of the layer thickness was calculated.

The specific evaluation way was as follows. The thickness of the photosensitive layer was measured in the portion having a uniform thickness. The portion having a thickness variation at the top portion and the end portion of the coating were avoided by making the thickness profile. The measurement was done at 10 places randomly selected. The average value thereof was decided to be the thickness. As a thickness measurement apparatus, "EDDY 560C" (Apparatus using an eddy current method, made by HELMUT FISHER GMBTE Co.) was used. The difference of the thickness between before and after the abrasion resistance test was calculated. An amount of decreased thickness (μm) per 100 krot (100,000 rotations) was obtained as an α value.

When the α value is 0.2 μm or less, the abrasion resistance is decided to satisfy the level of the present invention. The evaluation results are listed in Table 1.

(Evaluation of Surface Roughness)

After conducting the endurance test that was done for evaluation of abrasion resistance as described above, an A3 longitudinal belt chart was continuously printed on 20,000 sheets. The surface roughness Rz (μm) on the electrophotographic photoreceptor corresponding to the longitudinal belt portion and the white image portion were measures with a surface roughness measurement apparatus. The difference thereof was calculated as ΔRz (μm).

When ΔRz (μm) is 0.05 μm or less, the surface roughness is decided to satisfy the level of the present invention. The evaluation results are listed in Table 1.

TABLE 1

| Electro-photographic photoreceptor No. | Charge transport agent: Kind | Charge transport agent: Maximum absorption wavelength (nm) | Charge transport agent: Radical polymerizable functional group | Photopolymerization initiator | ΔG (eV) | Inorganic particle: Kind | Inorganic particle: Particle size (nm) | Evaluations: Memory resistive property | Evaluations: Abrasion resistive property (α value) (nm) | Evaluations: Surface roughness ΔRz (μm) | Evaluations: Spot fault | Remarks |
|---|---|---|---|---|---|---|---|---|---|---|---|---|
| 101 | RCTM-1 | 417 | Present | Irgacure 819*1 | −0.620 | — | — | ◎ | 0.18 | 0.050 | ◎ | Present invention |
| 102 | RCTM-1 | 417 | Present | Irgacure TPO*1 | −0.570 | $SiO_2$ | 20 | ◎ | 0.15 | 0.030 | ◎ | Present invention |
| 103 | RCTM-1 | 417 | Present | Irgacure OXE01*2 | −0.820 | $Al_2O_3$ | 30 | ◎ | 0.15 | 0.020 | ◎ | Present invention |
| 104 | RCTM-12 | 393 | Present | PI-9*2 | −0.250 | $SiO_2$ | 16 | ◎ | 0.05 | 0.010 | ◎ | Present invention |
| 105 | RCTM-2 | 420 | Present | Irgacure OXE01*2 | −0.850 | $SiO_2$ | 40 | ◎ | 0.08 | 0 | ◎ | Present invention |
| 106 | RCTM-3 | 417 | Present | Irgacure 819*1 | −0.590 | $SiO_2$ | 12 | ◎ | 0.12 | 0.020 | ◎ | Present invention |
| 107 | RCTM-25 | 405 | Present | Irgacure 819*1 | −0.770 | $SiO_2$ | 20 | ○ | 0.17 | 0.050 | ○ | Present invention |
| 108 | RCTM-1 | 417 | Present | PI-3/MBO | −1.000 | $SiO_2$ | 20 | ○ | 0.15 | 0.015 | ◎ | Present invention |
| 109 | RCTM-2 | 420 | Present | Irgacure OXE01*2 | −0.174 | $SiO_2$ | 20 | ○ | 0.35 | 0.200 | ◎ | Comparative example |
| 110 | RCTM-26 | 342 | Present | Irgacure 819*1 | −0.797 | $SiO_2$ | 20 | X | 0.05 | 0.050 | ○ | Comparative example |
| 111 | CTM-1 | 423 | Absent | Irgacure 819*1 | −0.180 | $SiO_2$ | 20 | ○ | 3.30 | 0.500 | X | Comparative example |
| 112 | CTM-2 | 394 | Absent | Irgacure 819*1 | −0.710 | $SiO_2$ | 20 | ○ | 0.18 | 0.300 | X | Comparative example |

*1Containing acyl phosphine oxide group structure
*2Containing O-acyl oxime group structure As are indicated by the evaluation results in Table 1, the electrophotographic photoreceptors 101 to 108 are excellent in memory resistive property, and abrasion resistive property, and further, variation of surface roughness, and generation of image fault were restrained compared with the electrophotographic photoreceptors 109 to 112.

What is claimed is:

1. An electrophotographic photoreceptor comprising a conductive support sequentially laminated thereon with at least a photosensitive layer and a protective layer in that order, wherein the protective layer includes a cured composition having a radical polymerizable compound for a binder, a charge transport agent having a radical polymerizable functional group, and a photopolymerization initiator;

the charge transport agent having a radical polymerizable functional group has a maximum absorption wavelength in the range of 405±50 nm; and the charge transport agent having a radical polymerizable functional group and the photopolymerization initiator satisfy Formula (A), $$\Delta G = Eox(D/D^+) - Ered(A^-/A) - E^* \leq -0.2 \text{ (eV)} \qquad \text{Formula (A):}$$

wherein ΔG represents a free energy difference, Eox(D/D$^+$) represents an oxidation potential of the charge transport agent having a radical polymerizable functional group, Ered(A$^-$/A) represents a reduction potential of the photopolymerization initiator, and E* represents an excitation energy of the charge transport agent having a radical polymerizable functional group.

2. The electrophotographic photoreceptor described in claim 1, wherein the photopolymerization initiator has an acyl phosphine oxide structure or an O-acyl oxime structure.

3. The electrophotographic photoreceptor described in claim 1, wherein the protective layer contains inorganic particles.

4. The electrophotographic photoreceptor described in claim 1, wherein the charge transport agent having a radical polymerizable functional group contains a structure represented by Formula (1), Formula (1)

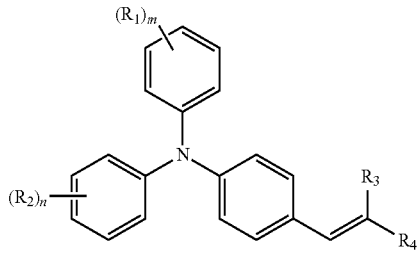

wherein, $R_1$ and $R_2$ each independently represent a substituent, at least one of $R_1$ and $R_2$ represents a methacryloyloxy group or an acryloyloxy group linked with an alkylene group of 1 to 5 carbon atoms; m and n each independently represent an integer of 0 to 5, provided that both m and n do not represent 0; and $R_3$ and $R_4$ each independently represent a hydrogen atom or a substituted or none-substituted aromatic ring group.

5. An image-forming apparatus provided with the electrophotographic photoreceptor described in claim 1.

6. An image-forming method using the electrophotographic photoreceptor described in claim 1.

7. A method for forming an electrophotographic photoreceptor comprising a conductive support sequentially laminated thereon with at least a photosensitive layer and a protective layer in that order, the method comprising the step of:

curing a composition having a radical polymerizable compound for a binder, a charge transport agent having a radical polymerizable functional group, and a photopolymerization initiator by irradiating with UV rays to form the protective layer, wherein the charge transport agent having a radical polymerizable functional group has a maximum absorption wavelength in the range of 405±50 nm, and the charge transport agent having a radical polymerizable functional group and the photopolymerization initiator satisfy Formula (A), $$\Delta G = Eox(D/D^{+}) - Ered(A^{-}/A) - E^{*} \leq -0.2 \text{ (eV)} \qquad \text{Formula (A):}$$

wherein, ΔG represents a free energy difference, Eox($D/D^{+}$) represents an oxidation potential of the charge transport agent having a radical polymerizable functional group, Ered($A^{-}/A$) represents a reduction potential of the photopolymerization initiator, and E* represents an excitation energy of the charge transport agent having a radical polymerizable functional group.

* * * * *